US012134493B2

(12) United States Patent
Palumbo

(10) Patent No.: US 12,134,493 B2
(45) Date of Patent: Nov. 5, 2024

(54) DEVICE AND METHOD FOR SETTING VACUUM TIME IN PACKAGING APPARATUSES AND PROCESSES

(71) Applicant: Cryovac, LLC, Charlotte, NC (US)

(72) Inventor: Riccardo Palumbo, Arona (IT)

(73) Assignee: Cryovac, LLC, Charlotte, NC (US)

( * ) Notice: Subject to any disclaimer, the term of this patent is extended or adjusted under 35 U.S.C. 154(b) by 243 days.

(21) Appl. No.: 17/776,627

(22) PCT Filed: Nov. 11, 2020

(86) PCT No.: PCT/EP2020/081793
§ 371 (c)(1),
(2) Date: May 13, 2022

(87) PCT Pub. No.: WO2021/094393
PCT Pub. Date: May 20, 2021

(65) Prior Publication Data

US 2022/0402639 A1 Dec. 22, 2022

(30) Foreign Application Priority Data

Nov. 14, 2019 (EP) ..... 19209223

(51) Int. Cl.

| | |
|---|---|
| ***B65B 31/02*** | (2006.01) |
| ***B65B 7/16*** | (2006.01) |
| ***B65B 51/10*** | (2006.01) |
| ***B65B 57/00*** | (2006.01) |

(52) U.S. Cl.
CPC ..... *B65B 57/00* (2013.01); *B65B 7/164* (2013.01); *B65B 31/028* (2013.01); *B65B 51/10* (2013.01)

(58) Field of Classification Search
CPC ..... B65B 7/16; B65B 7/164; B65B 31/02; B65B 31/024; B65B 31/025; B65B 31/028; B65B 31/04; B65B 51/10; B65B 57/00; B65B 2051/105
USPC ..... 53/432, 434, 510, 512
See application file for complete search history.

(56) References Cited

U.S. PATENT DOCUMENTS

| | | | | |
|---|---|---|---|---|
| 5,528,880 | A * | 6/1996 | Landolt | B65B 31/02 53/434 |
| 6,256,968 | B1 * | 7/2001 | Kristen | B65B 31/02 53/512 |
| 7,021,027 | B2 * | 4/2006 | Higer | B65B 31/046 53/434 |
| 11,053,036 | B2 | 7/2021 | Palumbo et al. | |

(Continued)

FOREIGN PATENT DOCUMENTS

| | | |
|---|---|---|
| CN | 102803077 A | 11/2012 |
| CN | 103402876 A | 11/2013 |

(Continued)

*Primary Examiner* — Stephen F. Gerrity
(74) *Attorney, Agent, or Firm* — Jon M. Isaacson

(57) ABSTRACT

A method and a device can be used for setting vacuum time in a packaging apparatus and in a packaging process. The method and device provide for determining, from pressure signals or from humidity signals detected in the vacuum chamber, a reference time instant. The method and device also provide for commanding a vacuum device either to stop extracting gas from the vacuum chamber or to execute one or more prescribed steps preluding to end of the vacuum cycle at expiration of a delay time interval following said reference time instant.

14 Claims, 6 Drawing Sheets

(56) References Cited

U.S. PATENT DOCUMENTS

| | | | | |
|---|---|---|---|---|
| 2004/0213879 | A1* | 10/2004 | Jang | B65B 31/02 426/404 |
| 2006/0016155 | A1* | 1/2006 | Oesterlein | B65B 31/02 53/510 |
| 2014/0109511 | A1* | 4/2014 | Hammad | B65B 31/04 53/79 |

FOREIGN PATENT DOCUMENTS

| | | | |
|---|---|---|---|
| CN | 104169174 | A | 11/2014 |
| CN | 105579345 | A | 5/2016 |
| CN | 107187638 | A | 9/2017 |
| CN | 107878846 | A | 4/2018 |
| CN | 208233484 | U | 12/2018 |
| EP | 2907759 | A1 | 8/2015 |
| WO | 2008022815 | A1 | 2/2008 |
| WO | 2015121266 | A1 | 8/2015 |
| WO | 2017021557 | A1 | 2/2017 |

* cited by examiner

FIG.2
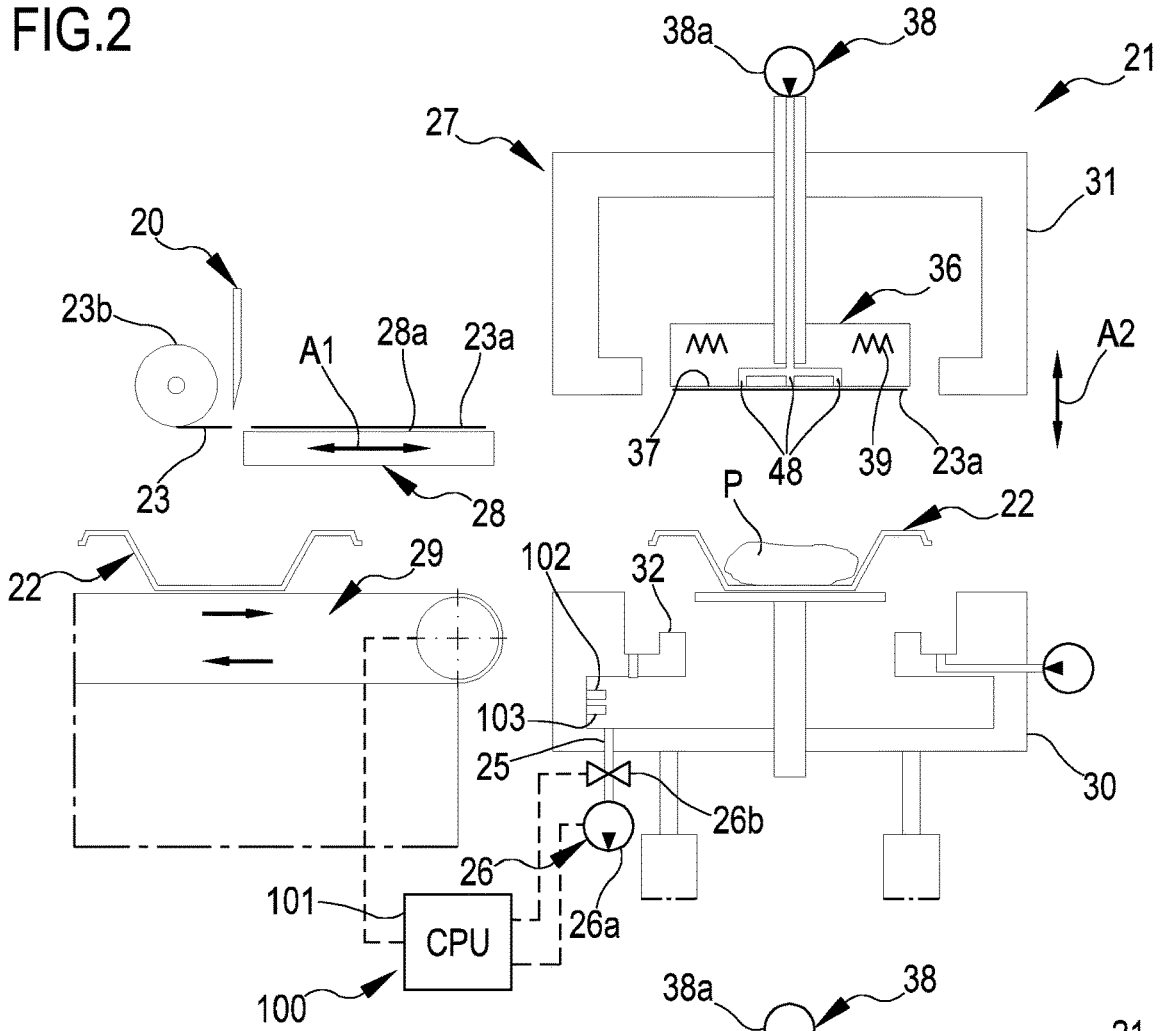
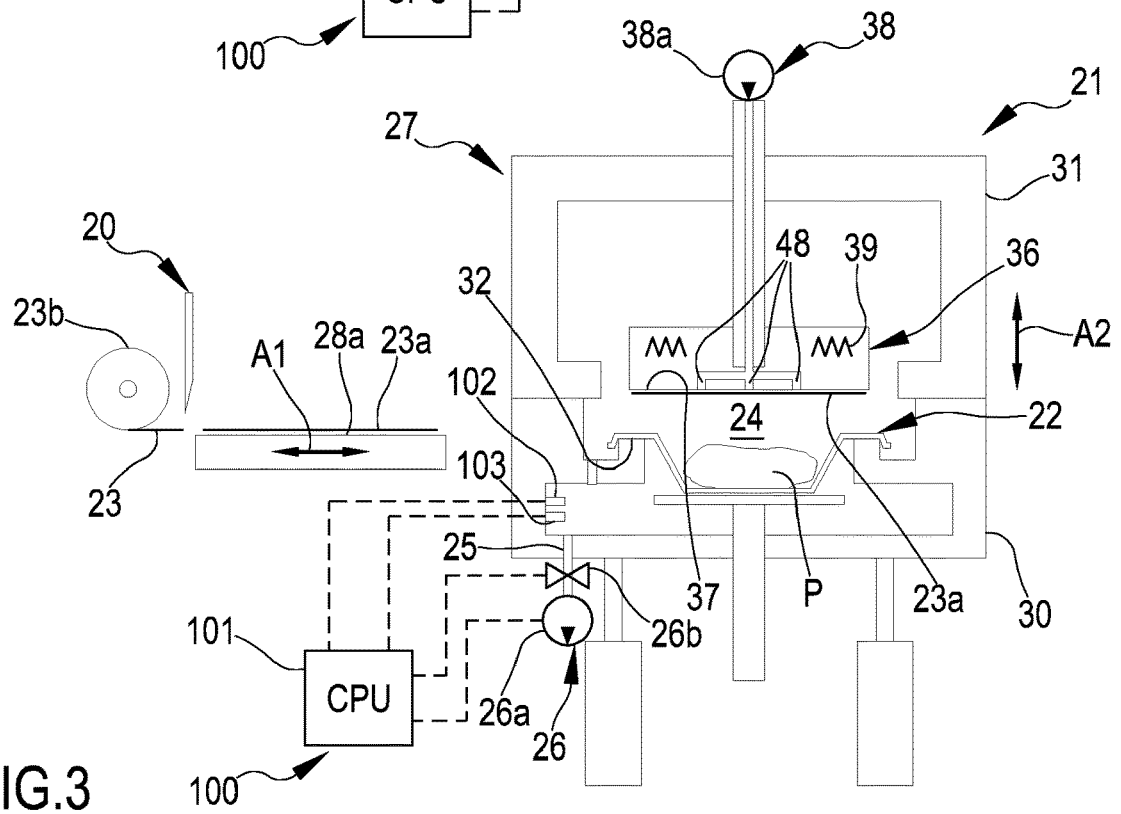
FIG.3

DEVICE AND METHOD FOR SETTING VACUUM TIME IN PACKAGING APPARATUSES AND PROCESSES

TECHNICAL FIELD

The present invention relates to a device and method for setting vacuum time in vacuum packaging apparatuses and in packaging processes. The invention also relates to a vacuum packaging apparatus and to a process for vacuum packaging of a product using said device and method for setting vacuum time. In accordance with certain aspects, the invention relates to an apparatus and process for skin packaging of a product using the device and method of setting vacuum time of the invention.

BACKGROUND ART

Plastic containers are used for the packaging of items, such as food or other products. Depending upon the type of packaging different vacuum packaging machines may be used: for example the product may be inserted in a bag which is then vacuumized and sealed. Alternatively, a product may be positioned in a tray or on a flat support and then a plastic film or a lid may be bonded above the tray or support to form one or more packages with vacuumization of the packages taking place before final sealing each package.

A technique, known as vacuum skin packaging, is particularly but not exclusively employed for packaging food products. Vacuum skin packaging is basically a thermoforming process. In particular, the product is placed on a support (such as a tray, a flat plate, a bowl or a cup) and then the support with the product placed thereon is put in a vacuum chamber, where a film of thermoplastic material, held by vacuum in a position above the product placed on the support, is heated to soften it. The space between the support and the film is then evacuated and finally vacuum above the film is released to cause the film to drape down all around the product and seal to the surface of the support not covered by the product, thus forming a tight skin around the product and on the support. In the case of a product protruding above the edge of the support, the film holder or upper tool may be concave and e.g. shaped as a dome in order to host the protruding portion of the product during application of the plastic skin. Alternatively the film holder or upper tool may be configured to present a movable portion in order to adapt to products of various heights.

In packaging cycles of vacuum packaging machines, the duration of air evacuation from the pack is typically set as follows:

a) Vacuum time: here duration dedicated to air removal is a pre-set time from start of vacuumization.
b) Vacuum level: here the phase of air removal is completed when a vacuum gauge, for example connected to the vacuum chamber where the package or part of it is placed, detects that a pre-set level of vacuum has been reached;
c) Combining above procedures a) and b): in other words, when a set vacuum threshold is reached, air removal is continued for a further pre-set time.

The inventor(s) noticed that vacuum quality when using the above criteria to control vacuum duration is affected by several factors, as discussed herein below.

A first factor is water (or other liquid) evaporation from the product surface; for example water heavily is present in most food products and thus, when vacuum is pulled in the vacuum chamber and reaches boiling pressure, water starts to generate moisture from the product surface; when evaporation starts, the vacuum gauge connected to the chamber shows a more horizontal trend in the sense that pressure does not go down as quickly as before start of evaporation: on the other hand, although vacuum level does not increase, generation of moisture inside the pack helps to remove air from the pack and, as a result, the vacuum quality of a pack is better if the product has water that evaporates than in case of a dry product; better vacuum quality when there is water evaporation is due to the fact that vacuum pumps decrease their efficiency when vacuum level approaches low values near 0 mbar. If there is moisture generation inside the pack, the vacuum pump works removing a gas with higher pressure (8-30 mbar) thus operating at higher efficiency. Moreover, as air is mixed with moisture, air is also removed together with moisture: the amount of air removed together with moisture when the pump works with 8-30 mbar is higher than the air removed by a pump working at lower pressure. Then, when the packaging cycle is completed and ambient pressure is re-vented in the vacuum chamber, moisture inside the pack condensates becoming water and disappears, thereby leaving a high quality vacuumized package.

A second factor is leakages: in fact, at the beginning of vacuum phase the vacuum chamber may be not perfectly closed and thus an air leakage may take place in the first part of vacuum phase. After a short while, vacuum inside the chamber generates a strong closing force which sealingly closes the vacuum chamber and leakages stop.

A third factor is the volume of the tray or other support: time dedicated to vacuum is in general longer when using big volume trays.

A fourth factor is the volume of the product: a big product takes big part of the volume of the vacuum chamber and the amount of air to be removed is thus less, thereby affecting vacuumization time.

All the above factors, may affect the time necessary to reach a given level of vacuumization and thus a given quality of the packaged product. In order to cope with this, what has been traditionally done is prolonging the vacuum time of each cycle. In other words, either the set vacuumization time is relatively long or, if pressure is used to detect achievement of a given low pressure, a set extra vacuum time added to make sure that the package reaches the desired level of vacuumization.

The above strategy has however several drawbacks. First prolonging vacuum time, inevitably prolongs the packaging cycle duration with increase of energy consumption and with reduced productivity.

Moreover, even prolonging vacuum time, the desired packaging quality may not be reached.

Thus, it is an object of the invention conceiving a device and a method for setting the vacuum time which is able to solve one or more of the above drawbacks.

In particular it is an object of the invention to conceive a device and method for setting vacuum time which effectively account for one or more of the described four factors affecting vacuum time and vacuum quality.

A further object is offering a new device and method capable of providing a more repeatable vacuum quality.

An additional object is offering a new device and method of setting vacuum time capable of providing a higher productivity irrespective of the conditions affecting vacuum time.

It is an auxiliary object providing a packaging process and a packaging apparatus using the method and device of the invention and thus able to overcome the limitations of the known solutions described above.

In particular, it is an object of the invention, to offer a packaging process and a packaging apparatus which may be effectively used to package products of various natures and sizes without compromising productivity or quality of the packaging.

An auxiliary object of the invention is to offer a packaging process and a packaging apparatus adapted for skin packaging of products.

SUMMARY OF THE INVENTION

One or more of the objects specified above are substantially achieved by a device and by a method for setting vacuum time in a packaging apparatus or in a packaging process according to any one of the appended claims. One or more of the above objects are also substantially achieved by a process and by an apparatus using the claimed method and device.

Aspects of the invention are here below disclosed.

A $1^{st}$ aspect concerns a device for setting vacuum time in a packaging apparatus, the packaging apparatus being of a type having:

a vacuum chamber (4; 24; 54);

a vacuum device (6; 26; 56) configured to extract gas from the vacuum chamber (4; 24; 54); and at least one of:

- a pressure sensor (102) configured to detect pressure present in the vacuum chamber (4; 24; 54) or in a conduit connected to the vacuum chamber (4; 24; 54), and
- a humidity sensor (103) configured to detect a humidity parameter of gas present in the vacuum chamber (4; 24; 54) or in a conduit connected to the vacuum chamber (4; 24; 54);

the device comprising a control unit (101) communicatively connectable to the vacuum device (6; 26; 56) and to at least one of the pressure sensor (102) and humidity sensor (103);

wherein the control unit (101) is configured for executing the following vacuum cycle:

commanding the vacuum device (6; 26; 56) to extract gas from the vacuum chamber (4; 24; 54);

receiving at least one of:

pressure signals from the pressure sensor (102), and humidity signals from the humidity sensor (103);

performing at least one of the following steps for determining at least one reference time instant ($T_1$) in the vacuum cycle:

- determining, from the pressure signals, the reference time instant ($T_1$) as the instant when pressure drops below a set pressure value ($P_1$),
- determining, from the pressure signals, the reference time instant ($T_1$) as the instant when a pressure variation parameter (dP/dt; (dP/dt)/P), in particular wherein the pressure variation parameter is function of the derivative of pressure over time, drops below a respective set value ($(dP/dt)_1$; $((dP/dt)/P)_1$),
- determining, from the humidity signals, the reference time instant ($T_1$) as the instant when the humidity parameter reaches a set humidity parameter value ($H_1$).

calculating a duration of a delay time (DT) at least based on when, in the vacuum cycle, said reference time instant ($T_1$) takes place.

In a $2^{nd}$ aspect according to the $1^{st}$ aspect, the vacuum cycle which the control unit is configured to execute further includes controlling the vacuum device (6; 26; 56) to maintain gas extraction from the vacuum chamber (4; 24; 54) at least for said delay time (DT) interval following said reference time instant ($T_1$).

In a $3^{rd}$ aspect according to any one of the preceding aspects, the duration of said delay time interval (DT) is not a constant pre-set value.

In a $4^{th}$ aspect according to any one of the preceding aspects, the control unit (101) is configured for calculating, during each vacuum cycle, the duration of said delay time (DT).

In a $5^{th}$ aspect according to any one of the preceding aspects, the duration of said delay time (DT) is calculated by the control unit based on when, in the vacuum cycle, said reference time instant ($T_1$) takes place.

In a $6^{th}$ aspect according to any one of the preceding aspects, the control unit (101) is configured to cause (as part of the vacuum cycle), at expiration of the calculated delay time (DT) interval following said reference time instant ($T_1$), execution of at least one further step which brings to end of the vacuum cycle.

In a $7^{th}$ aspect according to any one of the preceding aspects, the control unit (101) is configured to cause (as part of the vacuum cycle), at expiration of the calculated delay time (DT) interval following said reference time instant ($T_1$), execution of at least one further step which brings to end of the vacuum cycle; the at least one further step including: immediately commanding the vacuum device (6; 26; 56) to stop gas extraction from the vacuum chamber (4; 24; 54), or commanding execution of at least one prescribed event before commanding stop of gas extraction from the vacuum chamber (4; 24; 54).

In a $8^{th}$ aspect according to any one of the preceding aspects, duration of said delay time interval (DT) is calculated as a function of a duration of a start time interval ($\Delta T$) lasting from a start time instant ($T_0$) until the reference time instant ($T_1$).

In a $9^{th}$ aspect according to any one of the preceding aspects, duration of said delay time interval (DT) is calculated as a function of a duration of a start time interval ($\Delta T$) lasting from a start time instant ($T_0$) until the reference time instant ($T_1$); wherein the start time instant ($T_0$) is the instant when the control unit (101) commands extraction of gas from the vacuum chamber (4; 24; 54) to begin.

In a $10^{th}$ aspect according to any one of aspects from the $1^{st}$ to the $8^{th}$, duration of said delay time interval (DT) is calculated as a function of a duration of a start time interval ($\Delta T$) lasting from a start time instant ($T_0$) until the reference time instant ($T_1$); wherein the start time instant ($T_0$) is delayed from the instant when the control unit (101) commands extraction of gas from the vacuum chamber (4; 24; 54) to begin, said start time instant ($T_0$) being determined from said pressure signals as instant when pressure reaches a reference pressure value ($P_0$) which is below the value of atmospheric pressure present outside the vacuum chamber (4; 24; 54) and above said set pressure value ($P_1$).

In an $11^{th}$ aspect according to the preceding aspect the reference pressure value ($P_0$) is at least twice the set pressure value ($P_1$).

In a $12^{th}$ aspect according to the preceding aspect the reference pressure value is comprised between 500 and 800 mbar.

In a $13^{th}$ aspect according to any one of the preceding two aspects, the set pressure value is comprised between 30 and 300 mbar.

In a $14^{th}$ aspect according to any one of aspects from the $8^{th}$ to the $13^{th}$, the duration of the delay time interval (DT)

comprises calculating the product of the duration of the start time interval ($\Delta T$) times a given factor (K).

In a $15^{th}$ aspect according to any one of the preceding aspects, determining at least one reference time instant ($T_1$) in the vacuum cycle comprises determining a single reference time instant ($T_1$).

In a $16^{th}$ aspect the according to the preceding aspect, the reference time instant ($T_1$) is determined from the pressure signals, the reference time instant ($T_1$) being the instant when pressure drops below a set pressure value ($P_1$) comprised between 30 and 300 mbar.

In a $17^{th}$ aspect according to the $15^{th}$ aspect, the reference time instant ($T_1$) is determined from the pressure signals, the reference time instant ($T_1$) being the instant when pressure drops below a set pressure value ($P_1$) comprised between 5 and 40 mbar.

In a $18^{th}$ aspect according to the $15^{th}$ aspect, the reference time instant ($T_1$) is determined from the pressure signals, the reference time instant ($T_1$) being the instant when pressure derivative over time (dP/dt), in absolute value, drops below a set pressure derivative value ($(dP/dt)_1$) or changes by more than a given percentage relative to an initial value.

In a $19^{th}$ aspect according to the $15^{th}$ aspect, the reference time instant ($T_1$) is determined from the pressure signals, the reference time instant ($T_1$) being the instant when pressure derivative over time divided by pressure ((dP/dt)/P), in absolute value, drops below a respective set pressure value ($((dP/dt)/P)_1$) or changes by more than a given percentage relative to an initial value.

In a $20^{th}$ aspect according to the $15^{th}$ aspect, the reference time instant ($T_1$) is determined from the humidity signals, the reference time instant ($T_1$) being the instant when the humidity parameter reaches a set humidity parameter value ($H_1$); wherein the humidity parameter is relative humidity and the set humidity parameter value ($H_1$) is comprised between 70 and 100% of relative humidity.

In a $21^{st}$ aspect according to any one of aspects from the $8^{th}$ to the $20^{th}$, the duration of the delay time interval (DT) is made calculating the product of the duration of the start time interval ($\Delta T$) times given factor (K), wherein given factor (K) is either pre-stored in a memory connected to the control unit (101) or the control unit (101) is configured to receive the given factor from a user input.

In a $22^{nd}$ aspect according to the preceding aspect the duration of the delay time interval (DT) is made according to the formula:

$$DT=K\cdot(\Delta T) \quad (1).$$

In a $23^{rd}$ aspect according to any one of the preceding two aspects, the value of factor K is such that $0<K\leq 10$.

In a $24^{th}$ aspect according to any one of aspects from the $1^{st}$ to the $14^{th}$, determining at least one reference time instant in the vacuum cycle comprises determining a first reference time instant ($T_{11}$) and a second reference time instant ($T_{12}$).

In a $25^{th}$ aspect according to the preceding aspect the first reference time instant ($T_{11}$) is determined from the pressure signals, the first reference time instant ($T_{11}$) being the instant when pressure drops below a first set pressure value ($P_{11}$) comprised between 30 and 300 mbar.

In a $26^{th}$ aspect according to any one of the preceding two aspects the second reference time instant ($T_{12}$) is determined from the pressure signals, the second reference time instant ($T_{12}$) being the instant when pressure drops below a second set pressure value ($P_{12}$) comprised between 5 and 40 mbar.

In a $27^{th}$ aspect according to any one of the $24^{th}$ or $25^{th}$ aspect the second reference time instant ($T_{12}$) is determined from the pressure signals, the second reference time instant ($T_{12}$) being the instant when the absolute value of pressure derivative over time drops below a set pressure derivative value ($(dP/dt)_1$ or changes by more than a given percentage relative to an initial value.

In a $28^{th}$ aspect according to any one of the $24^{th}$ or $25^{th}$ aspect the second reference time instant ($T_{12}$) is determined from pressure the signals, the reference time instant ($T_{12}$) being the instant when pressure derivative over time divided by pressure ((dP/dt)/P), in absolute value, drops below a respective set pressure value ($((dP/dt)/P)_1$) or changes by more than a given percentage relative to an initial value.

In a $29^{th}$ aspect according to any one of the $24^{th}$ or $25^{th}$ aspect the second reference time instant ($T_{12}$) is determined from the humidity signals, the second reference time instant ($T_{12}$) being the instant when the humidity parameter reaches a set humidity parameter value ($H_1$).

In a $30^{th}$ aspect according to any one of aspects from the $24^{th}$ to the $29^{th}$ wherein the cycle comprises:

calculating a first duration of the start time interval ($\Delta T_1$) extending from the start time instant ($T_0$) until the first reference time instant ($T_{11}$), and calculating a second duration of the start time interval ($\Delta T_2$) extending from the start time instant ($T_0$) until the second reference time instant ($T_{12}$);

calculating the duration of the delay time interval (DT) as a function of the first duration of the start time interval ($\Delta T_1$) and of the second duration of the start time interval ($\Delta T_2$).

In a $31^{st}$ aspect according to the preceding aspect calculating the duration of the delay time interval (DT) as a function of the first duration of the start time interval ($\Delta T_1$) and of the second duration of the start time interval ($\Delta T_2$) comprises making the sum of the product of the first duration of the start time interval ($\Delta T_1$) times a first given factor ($K_1$) plus the second duration of the start time interval ($\Delta T_2$) times a second given factor ($K_2$).

In a $32^{nd}$ aspect according to the preceding aspect, calculating the duration of the delay time interval (DT) as a function of the first duration of the start time interval ($\Delta T_1$) and of the second duration of the start time interval ($\Delta T_2$) comprises making the sum of the product of the first duration of the start time interval ($\Delta T_1$) times a first given factor ($K_1$) plus the second duration of the start time interval ($\Delta T_2$) times a second given factor ($K_2$) according to the formula:

$$DT=K_1\cdot(\Delta T_1)+K_2\cdot(\Delta T_2) \quad (2);$$

optionally the value of factors $K_1$ and $K_2$ is such that $0<K_1\leq 5$, and $0<K_2\leq 5$.

In a $33^{rd}$ aspect according to any one of aspects from the $8^{th}$ to the $32^{nd}$, the control unit (101) is configured for commanding the vacuum device (6; 26; 56) to continuously maintain gas extraction from said vacuum chamber (4; 24; 54) for a cycle evacuation time (CET) lasting until expiration of said delay time interval (DT).

In a $34^{th}$ aspect according to the $33^{rd}$ aspect, the duration of the cycle evacuation time (CET) is:

the sum of the duration of the start time interval ($\Delta T$; $\Delta T_1$; $\Delta T_2$) plus the duration of the delay time interval (DT).

In a $35^{th}$ aspect according to the $33^{rd}$ aspect, the duration of the cycle evacuation time (CET) is:

the sum of the time interval from start of gas evacuation until time ($T_0$) plus the duration of the start time interval ($\Delta T$; $\Delta T_1$; $\Delta T_2$) plus the duration of the delay time interval (DT).

In a 36$^{th}$ aspect according to the 33$^{rd}$ aspect, the duration of the cycle evacuation time (CET) is:

the sum of the duration of the start time interval ($\Delta T$; $\Delta T_1$; $\Delta T_2$) plus the duration of the delay time interval (DT), plus the duration of further delay time ($\delta t$).

In a 37$^{th}$ aspect according to the 33$^{rd}$ aspect, the duration of the cycle evacuation time (CET) is:

the sum of the time interval from start of gas evacuation until time ($T_0$) plus the duration of the start time interval ($\Delta T$; $\Delta T_1$; $\Delta T_2$) plus the duration of the delay time interval (DT), plus the duration of further delay time ($\delta t$).

A 38$^{th}$ aspect concerns a packaging apparatus comprising:

at least one vacuum chamber (4), configured for receiving an entire semi-sealed package (8) to be vacuumized, the semi-sealed package containing a respective product (P), a vacuum device (6) configured to extract gas from the vacuum chamber (4);

at least one of:

a pressure sensor (102) configured to detect pressure present in the vacuum chamber (4) or in a conduit connected to the vacuum chamber (4), and a humidity sensor (103) configured to detect a humidity parameter of gas present in the vacuum chamber (4) or in a conduit connected to the vacuum chamber (4);

a device according to any one of the preceding aspects; and at least one sealer configured to seal the semi-sealed package (8) to form a sealed package.

A 39$^{th}$ aspect concerns a packaging apparatus comprising:

at least one vacuum chamber (24), configured for receiving a support (22) having a superior surface supporting or containing a product (P) and a closure film (23*a*) above the support;

a vacuum device (26) configured to extract gas from the vacuum chamber (24);

at least one of:

a pressure sensor (102) configured to detect pressure present in the vacuum chamber (24) or in a conduit connected to the vacuum chamber (24), and a humidity sensor (103) configured to detect a humidity parameter of gas present in the vacuum chamber (24) or in a conduit connected to the vacuum chamber (24);

a device according to any one of the preceding aspects; and at least one sealer configured to sealingly close the closure film (23*a*) above the support (22) and around the product to form a sealed package.

A 40$^{th}$ aspect concerns a packaging apparatus comprising:

at least one vacuum chamber (54), configured for receiving a continuous body (49) having cavities (49*a*) for a product (P) and a top film (50);

a vacuum device (56) configured to extract gas from the vacuum chamber (54);

at least one of:

a pressure sensor (102) configured to detect pressure present in the vacuum chamber (54) or in a conduit connected to the vacuum chamber (54), and a humidity sensor (103) configured to detect a humidity parameter of gas present in the vacuum chamber (54) or in a conduit connected to the vacuum chamber (54);

a device according to any one of the preceding aspects; and at least one sealer configured to sealingly close the top film (50) on the continuous body (49) to sealingly close said cavities (49*a*).

A 41$^{st}$ aspect concerns a method of setting vacuum time in a packaging apparatus, the packaging apparatus having:

a vacuum chamber (4; 24; 54);

a vacuum device (6; 26; 56) configured to extract gas from the vacuum chamber (4; 24; 54); and at least one of:

a pressure sensor (102) configured to detect pressure present in the vacuum chamber (4; 24; 54) or in a conduit connected to the vacuum chamber (4; 24; 54), and a humidity sensor (103) configured to detect a humidity parameter of gas present in the vacuum chamber (4; 24; 54) or in a conduit connected to the vacuum chamber (4; 24; 54);

the method providing for execution of the following vacuum cycle:

commanding the vacuum device (6; 26; 56) to extract gas from the vacuum chamber (4; 24; 54);

receiving at least one of:

pressure signals from the pressure sensor (102), and humidity signals from the humidity sensor (103);

performing at least one of the following steps for determining at least one reference time instant ($T_1$) in the vacuum cycle:

determining, from the pressure signals, the reference time instant ($T_1$) as the instant when pressure drops below a set pressure value ($P_1$), determining, from the pressure signals, the reference time instant ($T_1$) as the instant when a pressure variation parameter (dP/dt; (dP/dt)/P), in particular wherein the pressure variation parameter is function of the derivative of pressure over time, drops below a respective set value ($(dP/dt)_1$; $((dP/dt)/P)_1$), determining, from the humidity signals, the reference time instant ($T_1$) as the instant when the humidity parameter reaches a set humidity parameter value ($H_1$).

calculating a duration of a delay time (DT) at least based on when, in the vacuum cycle, said reference time instant ($T_1$) takes place.

In a 42$^{nd}$ aspect according to the 41$^{st}$ aspect, the vacuum cycle includes controlling the vacuum device (6; 26; 56) to maintain gas extraction from the vacuum chamber (4; 24; 54) at least for said delay time (DT) interval following said reference time instant ($T_1$).

In a 43$^{rd}$ aspect according to any one of the preceding 2 aspects, the duration of said delay time interval (DT) is not a constant pre-set value.

In a 44$^{th}$ aspect according to any one of the preceding 3 aspects, the method calculates, during each vacuum cycle, the duration of said delay time (DT).

In a 45$^{th}$ aspect according to any one of the preceding 4 aspects, the duration of said delay time (DT) is calculated based on when, in the vacuum cycle, said reference time instant ($T_1$) takes place.

In a 46$^{th}$ aspect according to any one of the preceding 5 aspects, as part of the vacuum cycle, at expiration of the calculated delay time (DT) interval following said reference time instant ($T_1$), the method provides for execution of at least one further step which brings to end of the vacuum cycle.

In a 47$^{th}$ aspect according to any one of the preceding 6 aspects, as part of the vacuum cycle, at expiration of the calculated delay time (DT) interval following said reference time instant ($T_1$), the method provides for execution of at least one further step which brings to end of the vacuum cycle; the at least one further step including: immediately commanding the vacuum device (6; 26; 56) to stop gas extraction from the vacuum chamber (4; 24; 54), or commanding execution of at least one prescribed event before commanding stop of gas extraction from the vacuum chamber (4; 24; 54).

In a 48$^{th}$ aspect according to any one of the preceding 7 aspects, duration of said delay time interval (DT) is calculated as a function of a duration of a start time interval ($\Delta T$) lasting from a start time instant ($T_0$) until the reference time instant ($T_1$).

In a 49$^{th}$ aspect according to any one of the 8 preceding aspects, duration of said delay time interval (DT) is calculated as a function of a duration of a start time interval ($\Delta T$) lasting from a start time instant ($T_0$) until the reference time instant ($T_1$); wherein the start time instant ($T_0$) is the instant when the control unit (101) commands extraction of gas from the vacuum chamber (4; 24; 54) to begin.

In a 50$^{th}$ aspect according to any one of aspects from the 41$^{st}$ to the 48$^{th}$, duration of said delay time interval (DT) is calculated as a function of a duration of a start time interval ($\Delta T$) lasting from a start time instant ($T_0$) until the reference time instant ($T_1$); wherein the start time instant ($T_0$) is delayed from the instant when the control unit (101) commands extraction of gas from the vacuum chamber (4; 24; 54) to begin, said start time instant ($T_0$) being determined from said pressure signals as instant when pressure reaches a reference pressure value ($P_0$) which is below the value of atmospheric pressure present outside the vacuum chamber (4; 24; 54) and above said set pressure value ($P_1$).

In an 51$^{st}$ aspect according to the preceding aspect the reference pressure value ($P_0$) is at least twice the set pressure value ($P_1$).

In a 52$^{nd}$ aspect according to the preceding aspect the reference pressure value ($P_0$) is comprised between 500 and 800 mbar.

In a 53$^{rd}$ aspect according to any one of the preceding two aspects, the set pressure value ($P_1$) is comprised between 30 and 300 mbar.

In a 54$^{th}$ aspect according to any one of aspects from the 48$^{th}$ to the 53$^{th}$, the duration of the delay time interval (DT) comprises calculating the product of the duration of the start time interval ($\Delta T$) times a given factor (K).

In a 55$^{th}$ aspect according to any one of the preceding aspects, determining at least one reference time instant ($T_1$) in the vacuum cycle comprises determining a single reference time instant ($T_1$).

In a 56$^{th}$ aspect the according to the preceding aspect, the reference time instant ($T_1$) is determined from the pressure signals, the reference time instant ($T_1$) being the instant when pressure drops below a set pressure value ($P_1$) comprised between 30 and 300 mbar.

In a 57$^{th}$ aspect according to the 55$^{th}$ aspect, the reference time instant ($T_1$) is determined from the pressure signals, the reference time instant ($T_1$) being the instant when pressure drops below a set pressure value ($P_1$) comprised between 5 and 40 mbar.

In a 58$^{th}$ aspect according to the 55$^{th}$ aspect, the reference time instant ($T_1$) is determined from the pressure signals, the reference time instant ($T_1$) being the instant when pressure derivative over time (dP/dt), in absolute value, drops below a set pressure derivative value ($(dP/dt)_1$) or changes by more than a given percentage relative to an initial value.

In a 59$^{th}$ aspect according to the 55$^{th}$ aspect, the reference time instant ($T_1$) is determined from the pressure signals, the reference time instant ($T_1$) being the instant when pressure derivative over time divided by pressure ((dP/dt)/P), in absolute value, drops below a respective set pressure value ($((dP/dt)/P)_1$) or changes by more than a given percentage relative to an initial value.

In a 60$^{th}$ aspect according to the 55$^{th}$ aspect, the reference time instant ($T_1$) is determined from the humidity signals, the reference time instant ($T_1$) being the instant when the humidity parameter reaches a set humidity parameter value ($H_1$); wherein the humidity parameter is relative humidity and the set humidity parameter value ($H_1$) is comprised between 70 and 100% of relative humidity.

In a 61$^{st}$ aspect according to any one of aspects from the 48$^{th}$ to the 60$^{th}$, the duration of the delay time interval (DT) is made calculating the product of the duration of the start time interval ($\Delta T$) times given factor (K), wherein given factor (K) is either pre-stored in a memory connected to the control unit (101) or the control unit (101) is configured to receive the given factor from a user input.

In a 62$^{nd}$ aspect according to the preceding aspect the duration of the delay time interval (DT) is made according to the formula:

$$DT=K\cdot(\Delta T) \quad (1).$$

In a 63$^{rd}$ aspect according to any one of the preceding two aspects, the value of factor K is such that $0<K\leq 10$.

In a 64$^{th}$ aspect according to any one of aspects from the 41$^{st}$ to the 54$^{th}$, determining at least one reference time instant in the vacuum cycle comprises determining a first reference time instant ($T_{11}$) and a second reference time instant ($T_{12}$).

In a 65$^{th}$ aspect according to the preceding aspect the first reference time instant ($T_{11}$) is determined from the pressure signals, the first reference time instant ($T_{11}$) being the instant when pressure drops below a first set pressure value ($P_{11}$) comprised between 30 and 300 mbar.

In a 66$^{th}$ aspect according to any one of the preceding two aspects the second reference time instant ($T_{12}$) is determined from the pressure signals, the second reference time instant ($T_{12}$) being the instant when pressure drops below a second set pressure value ($P_{12}$) comprised between 5 and 40 mbar.

In a 67$^{th}$ aspect according to any one of the 64$^{th}$ or 65$^{th}$ aspect the second reference time instant ($T_{12}$) is determined from the pressure signals, the second reference time instant ($T_{12}$) being the instant when the absolute value of pressure derivative over time drops below a set pressure derivative value ($(dP/dt)_1$ or changes by more than a given percentage relative to an initial value.

In a 68$^{th}$ aspect according to any one of the 64$^{th}$ or 65$^{th}$ aspect the second reference time instant ($T_{12}$) is determined from pressure the signals, the reference time instant ($T_{12}$) being the instant when pressure derivative over time divided by pressure ((dP/dt)/P), in absolute value, drops below a respective set pressure value ($((dP/dt)/P)_1$) or changes by more than a given percentage relative to an initial value.

In a 69$^{th}$ aspect according to any one of the 64$^{th}$ or 65$^{th}$ aspect the second reference time instant ($T_{12}$) is determined from the humidity signals, the second reference time instant ($T_{12}$) being the instant when the humidity parameter reaches a set humidity parameter value ($H_1$).

In a 70$^{th}$ aspect according to any one of aspects from the 64$^{th}$ to the 69$^{th}$ wherein the cycle comprises:

calculating a first duration of the start time interval ($\Delta T_1$) extending from the start time instant ($T_0$) until the first reference time instant ($T_{11}$), and calculating a second duration of the start time interval ($\Delta T_2$) extending from the start time instant ($T_0$) until the second reference time instant ($T_{12}$);

calculating the duration of the delay time interval (DT) as a function of the first duration of the start time interval ($\Delta T_1$) and of the second duration of the start time interval ($\Delta T_2$).

In a 71$^{st}$ aspect according to the preceding aspect calculating the duration of the delay time interval (DT) as a function of the first duration of the start time interval ($\Delta T_1$)

and of the second duration of the start time interval ($\Delta T_2$) comprises making the sum of the product of the first duration of the start time interval ($\Delta T_1$) times a first given factor ($K_1$) plus the second duration of the start time interval ($\Delta T_2$) times a second given factor ($K_2$).

In a $72^{nd}$ aspect according to the preceding aspect, calculating the duration of the delay time interval (DT) as a function of the first duration of the start time interval ($\Delta T_1$) and of the second duration of the start time interval ($\Delta T_2$) comprises making the sum of the product of the first duration of the start time interval ($\Delta T_1$) times a first given factor ($K_1$) plus the second duration of the start time interval ($\Delta T_2$) times a second given factor ($K_2$) according to the formula:

$$DT=K_1\cdot(\Delta T_1)+K_2\cdot(\Delta T_2) \quad (2);$$

optionally the value of factors $K_1$ and $K_2$ is such that $0<K_1\leq 5$, and $0<K_2\leq 5$.

In a $73^{rd}$ aspect according to any one of aspects from the $48^{th}$ to the $72^{nd}$, the method provides for commanding the vacuum device (6; 26; 56) to continuously maintain gas extraction from said vacuum chamber (4; 24; 54) for a cycle evacuation time (CET) lasting until expiration of said delay time interval (DT).

In a $74^{th}$ aspect according to the $73^{rd}$ aspect, the duration of the cycle evacuation time (CET) is:

the sum of the duration of the start time interval ($\Delta T$; $\Delta T_1$; $\Delta T_2$) plus the duration of the delay time interval (DT).

In a $75^{th}$ aspect according to the $73^{rd}$ aspect, the duration of the cycle evacuation time (CET) is:

the sum of the time interval from start of gas evacuation until time ($T_0$) plus the duration of the start time interval ($\Delta T$; $\Delta T_1$; $\Delta T_2$) plus the duration of the delay time interval (DT).

In a $76^{th}$ aspect according to the $73^{rd}$ aspect, the duration of the cycle evacuation time (CET) is:

the sum of the duration of the start time interval ($\Delta T$; $\Delta T_1$; $\Delta T_2$) plus the duration of the delay time interval (DT), plus the duration of further delay time ($\delta t$).

In a $77^{th}$ aspect according to the $73^{rd}$ aspect, the duration of the cycle evacuation time (CET) is:

the sum of the time interval from start of gas evacuation until time ($T_0$) plus the duration of the start time interval ($\Delta T$; $\Delta T_1$; $\Delta T_2$) plus the duration of the delay time interval (DT), plus the duration of further delay time ($\delta t$).

In a $78^{th}$ aspect according to any one of aspects from $41^{st}$ to $77^{th}$ the above method and in particular the above vacuum cycle may be executed by a suitably programmed or suitably configured control unit, for example a control unit of the device of the preceding aspects from $1^{st}$ to $37^{th}$ or a control unit of the apparatus of aspects from the $38^{th}$ to the $40^{th}$.

A $79^{th}$ aspect concerns a packaging process comprising:

positioning in a vacuum chamber (4) an entire semi-sealed package (8) to be vacuumized, the semi-sealed package containing a respective product (P), executing a method according to any one of the preceding aspects from $41^{st}$ to $78^{th}$; and sealing the semi-sealed package (8) to form a sealed package.

A $80^{th}$ aspect concerns a packaging process comprising:

positioning in a vacuum chamber (24) a support (22) having a superior surface supporting or containing a product (P) and a closure film (23*a*) above the support;

executing a method according to any one of the preceding aspects from $41^{st}$ to $78^{th}$; and sealingly close the closure film (23*a*) above the support (22) and around the product to form a sealed package.

A $81^{st}$ aspect concerns a packaging process comprising:

at least one vacuum chamber (4; 24; 54), configured for receiving a continuous body (49) having cavities (49*a*) for a product (P) and a top film (50);

executing a method according to any one of the preceding aspects from $41^{st}$ to $78^{th}$; and sealingly close the top film (50) on the continuous body (49) to sealingly close said cavities (49*a*).

An $82^{nd}$ aspect concerns data carrier comprising instructions memorized in the data carrier, wherein:

said instructions when executed by the control unit (101) of the device according to any one of aspects from the $1^{st}$ to the $37^{th}$ configuring or programming the control unit (101) to execute the vacuum cycle.

An $83^{rd}$ aspect concerns data carrier comprising instructions memorized in the data carrier, wherein:

said instructions when executed by the control unit (101) of a packaging apparatus configuring the control unit (101) to execute the method of setting vacuum time according to any one of aspects from $41^{st}$ to $78^{th}$.

An $84^{th}$ aspect concerns a retrofit kit for installation in a packaging apparatus, the retrofit kit comprising the device of any one of aspects from the $1^{st}$ to the $37^{th}$.

An $85^{th}$ aspect concerns a retrofit kit for installation in a packaging apparatus, the retrofit kit comprising the data carrier of aspect $82^{nd}$ or $83^{rd}$.

An $86^{th}$ aspect concerns a retrofit kit for installation in a packaging apparatus, the retrofit kit comprising the device of any one of aspects from the $1^{st}$ to the $37^{th}$ and the data carrier of aspect $82^{nd}$ or $83^{rd}$.

In an $87^{th}$ aspect according to any one of the preceding 3 aspects, the retrofit kit further comprises a pressure sensor (102) configured to detect pressure present in the vacuum chamber (4; 24; 54) or in a conduit connected to the vacuum chamber (4; 24; 54).

In an $88^{th}$ aspect according to any one of the preceding 4 aspects, the retrofit kit comprises a humidity sensor (103) configured to detect a humidity parameter of gas present in the vacuum chamber (4; 24; 54) or in a conduit connected to the vacuum chamber (4; 24; 54).

BRIEF DESCRIPTION OF THE DRAWINGS

Aspects of the present invention are disclosed in the following detailed description, given by way of example and not of limitation, to be read with reference to the accompanying drawings, wherein:

FIGS. 2-4 are schematic views of a vacuum skin packaging machine for making vacuum skin packages using a pre-made support in the form of a tray or of a flat plate and a top film;

FIGS. 6 and 7 are herein used to describe a possible way to operate of the device and method the invention;

FIG. 8 is herein used to describe a further possible way to operate of the device and method the invention.

DEFINITIONS AND CONVENTIONS

Figure 1:
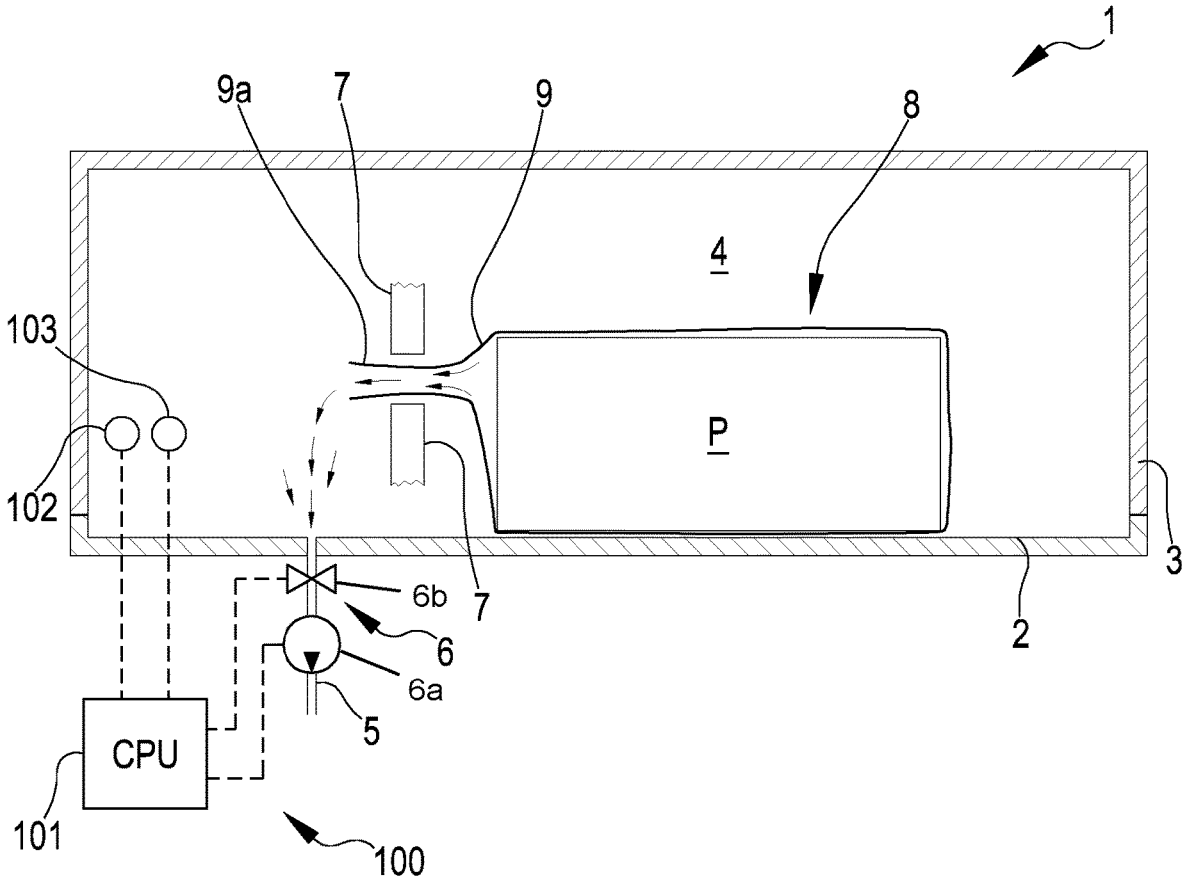
FIG. 1 shows a schematic cross section of a machine for forming vacuum in a bag type package.

It should be noted that in the present detailed description corresponding parts shown in the various figures are indicated with the same reference numeral through the figures. Note that the figures may not be scale and thus the parts and components shown therein are schematic representations.

Vacuum package: package hosting one or more products without or with very few air remaining inside the package.

Vacuum packages may be obtained using various methodologies extracting gas (for example air) from a preformed package or from a package under formation. Vacuum packages may be entirely made from plastic films or they may comprise a support, such as a tray a bowl or a flat plate, made in plastic material, metal, paperboard, paper or combinations thereof, above which a plastic film is sealingly applied.

Vacuum skin package: a vacuum package comprising one or more plastic films adhering as skin to the product contained in the package; in certain cases where a support is used the plastic film also adheres to the part of the support surface not covered by the product.

DETAILED DESCRIPTION

The present invention concerns a new method and a new device for setting vacuum time in a packaging apparatus or in a packaging process of the type using a vacuum chamber for extracting gas from a package under formation or from a semi-sealed bag or from a preformed package in order to then form a vacuum package, in particular a vacuum skin package. In packaging apparatuses and processes of the above type it is important properly setting the vacuum time, i.e., the time interval during which gas is actually extracted from the evacuation chamber: a proper setting of the vacuum time allows to obtain a high quality vacuum package without negatively impacting on the overall duration of the packaging cycle.

For example the device and method of the invention may be applied to the packaging apparatus 1 schematically shown in FIG. 1 comprising at least a lower element 2 and an upper element 3, which may be relatively moved between an open position allowing to load one or more semi-sealed packages 8 to be vacuumized, and a closed position, forming a vacuum chamber 4. FIG. 1 shows one semi-sealed package 8 hosting one product P, but of course the vacuum chamber 4 may be designed to receive a plurality of semi-sealed packages 8 with respective products. It should also be noted that, although in FIG. 1 a semi-sealed package in the form of a bag is exemplarily shown, other types of plastic containers may be used: for example the vacuum chamber 4 may receive a sealed film package (not yet vacuumized) and then a piercing or cutting device (not shown) may operate to pierce the package or to cut a portion of the package film and form one or more apertures for evacuation of gas. In the closed position, the vacuum chamber 4 is hermetically isolated from the ambient outside the chamber 4 in the sense that gas may only be extracted from chamber 4 through one or more appropriate evacuation lines 5 connected to at least one vacuum source. In this respect a vacuum device 6 is provided which may be operated to extract gas from chamber 4 through the evacuation line or lines 5. The vacuum device 6 may comprise at least one vacuum pump 6*a* active on at least one evacuation line 5 connecting the inside of said chamber 4 to the vacuum pump 6*a*; at least one valve 6*b* may also be provided (and for example be part of the vacuum device 6) for selectively opening and closing evacuation line 5; in one example a control unit 101 may be configured such that during the vacuum cycle the vacuum pump 6*a* is continuously operated, while the valve is opened or closed in order to extract or not gas from the vacuum or packaging chamber 4; alternatively the vacuum pump 6*a* may be constantly switched on and operated, while the control unit only controls (during the vacuum cycle) the valve 6*b* to open or close to respectively withdraw or not gas from the vacuum or packaging chamber 4 through line 5. Once gas has been extracted, a sealing device 7 may be operated to close the aperture or the apertures of the semi-sealed package 8 and thereby obtain a sealed vacuum skin package: in FIG. 1, the sealing device 7 takes the form of one or more heating bars or one or more heating rollers which may be approached the one against the other to heat bond the terminal portion 9 of the semi-sealed package 8. Of course other sealing devices may be contemplated for instance of the type heat bonding or gluing a closure patch to the aperture or apertures present in the semi-sealed package.

Figure 4:
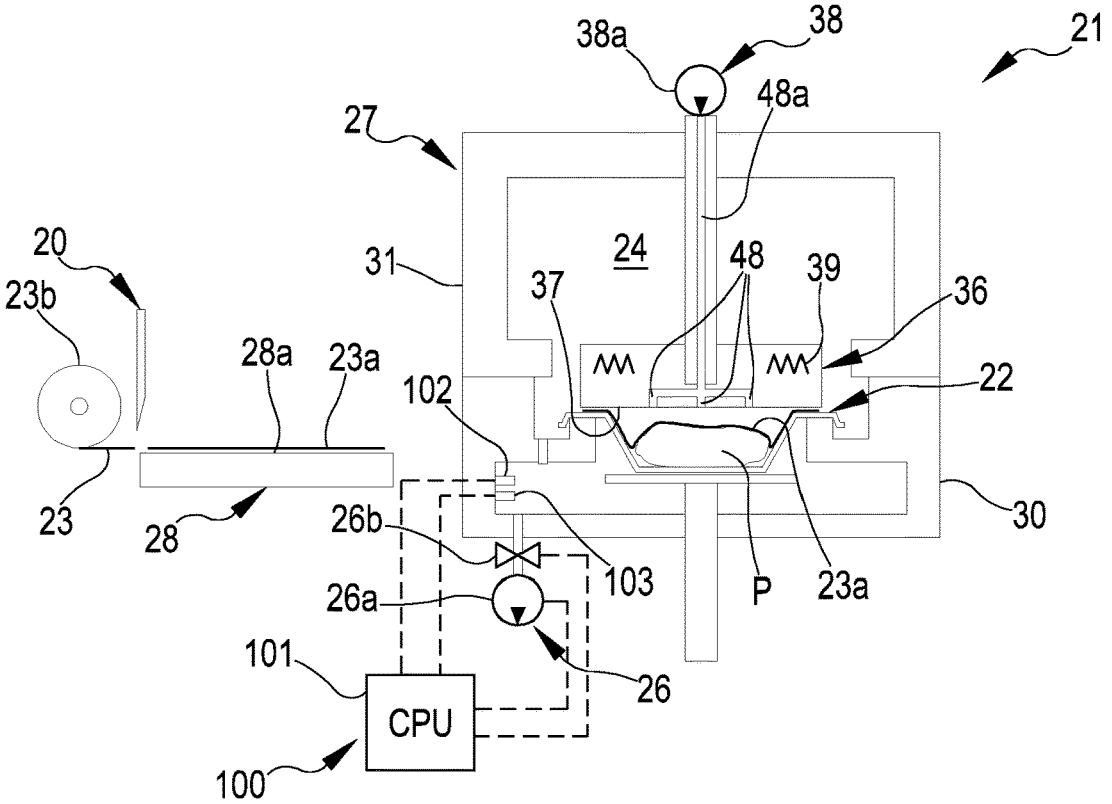
Figure 5:
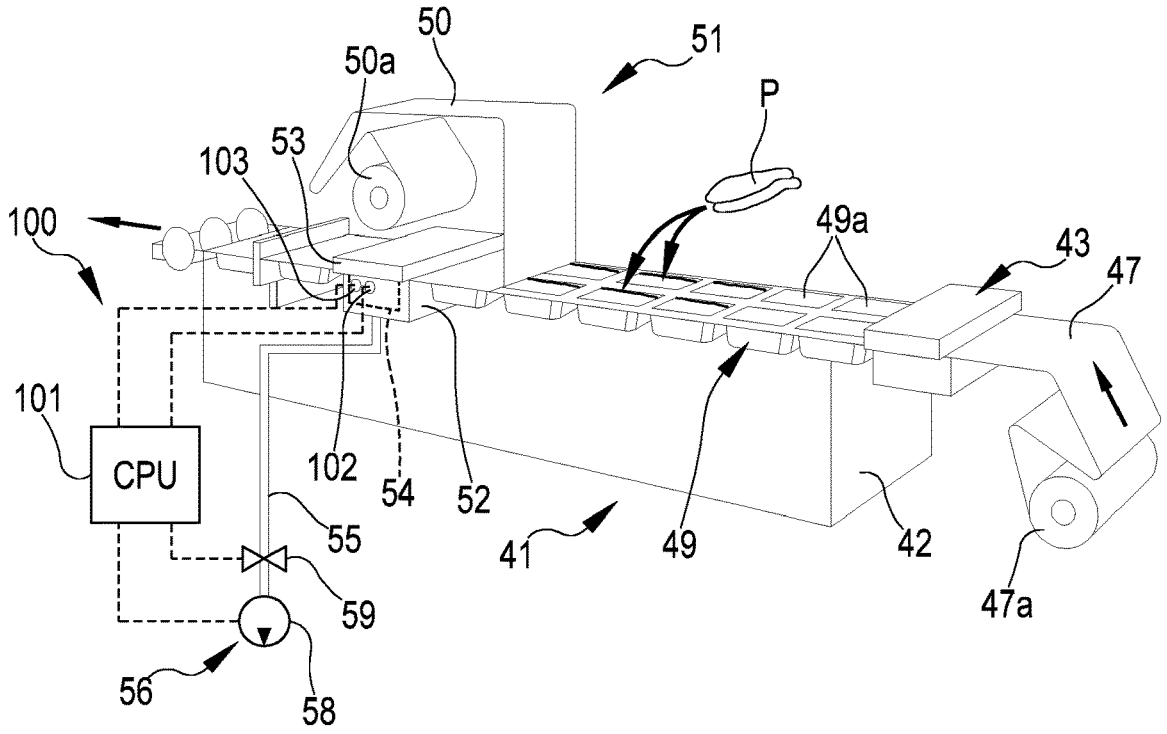
FIG. 5 is a schematic perspective view of a machine designed for in-line thermoforming tray cavities in a bottom film; the machine also feeds a top film which is coupled to the bottom film for making a plurality of vacuum skin packages.

The device and method of the invention may be applied to the packaging apparatus 21 schematically shown in FIGS. 2-4; the apparatus 21 is designed for packaging of a product P arranged on a support or tray 22. The apparatus 21 is adapted for vacuum skin packaging of the product P, where a thin film of plastic material, such as film sheet is draped down on the product P and intimately adheres to a surface of the support 22 as well as to the product surface thus leaving a minimum, if any, amount of air within the packaging. The apparatus 21 of FIGS. 3-5 is designed for cutting a continuous film 23 (e.g. fed from roll 23*b*) into discrete film sheets 23*a* at a location, where cutting station 20 operates, spaced from and positioned outside a packaging assembly 27, which is only schematically shown. The apparatus 21 comprises a transfer device 28, to move the cut film sheets into the packaging assembly 27, where the film sheets 23*a* are bonded to the respective supports or trays 22. Of course, it is not excluded that the film be instead fed to the packaging assembly without being pre-cut into film sheets and rather remaining in the form of a continuous film which is then cut to an appropriate measure either inside the packaging assembly or at the end of the packaging process. The apparatus 21 may also comprise a conveyor 29 for displacing the supports or trays 22 from a supply station (not shown) to the packaging assembly 27. The packaging assembly 27 is configured for tightly fixing the film sheets 23*a* to said supports 22 and comprises a lower tool 30 and an upper tool 31. The lower tool 30 comprises a prefixed number of seats 32 for receiving said one or more supports 22, while the upper tool 31 is configured for holding at least a portion of the film sheet 23*a*. The upper tool and the lower tool are configured to be movable the one relative to the other between at least a first operating condition, where the lower tool 30 and the upper tool 31 are spaced apart and allow positioning of the one or more supports 22 at said seats 32 (FIG. 3), and a second operating condition, where the lower tool 30 and the upper tool 31 are approached the one against the other such as to define or contribute to define a vacuum chamber 24 also here below equivalently referred to as packaging chamber 24 (FIGS. 4 and 5). The vacuum chamber or packaging chamber 24 may be hermetically closed with respect to the outside atmosphere, meaning that the packaging chamber 24 may be brought to a condition where it cannot freely communicate with the atmosphere outside the same chamber and gas may only be supplied or withdrawn from the chamber via appropriate supply or discharge channels under the control of the apparatus 21. As schematically shown in FIGS. 3-5, the cut film sheets 23*a* may be moved into the packaging chamber 24 of the assembly 27 by means of transfer device 28, which may be of any suitable kind: for example, in accordance with a 1$^{st}$ possible alternative, the transfer device may include a movable transfer plate 28*a* receiving the cut film sheet 23*a* at the cutting station where the cutting assembly cuts the film sheets 23*a*. The movable transfer plate 28*a* may be displaced to and from the packaging assembly 27 (see arrow A1), in order to position each film sheet 23*a* under the upper tool 31 and in order to return to or next to the cutting station 20 and pick a new set of cut film sheets. Alternatively, the transfer device 28 may include a mechanism configured to move the upper tool from the packaging assembly 27 to the position where the cutting assembly cuts the film sheets; in this way the upper tool 31 is allowed to pick the cut film sheet(s) and return to the packaging assembly in alignment with the lower tool thereby bringing the cut film sheet(s) into the packaging chamber and above the supports or trays. The upper tool 31 comprises a head 36 having a respective active surface 37 configured for receiving the cut film sheets. Holding means 38 are associated to the head 36 and are configured for attracting the film sheets 23*a* towards the active surface 37: the holding means exemplified in FIGS. 3-5 comprise a vacuum source 38*a* (e.g. including a vacuum pump) connected to suction holes 48 located at the active surface 37. One or more heaters 39 may be present and configured to heat at least the active surface 37 of the head 36. The heater(s) means may include resistances or inductances (e.g. in the form of printed circuits) or other type of heater(s) located inside the head 36 or in proximity of the active surface 37 (such has heating irradiators) and capable of at least directly or indirectly heating the active surface. Once the film sheet(s) has been positioned at the active surface 37 (and the transfer device 28 has left the packaging assembly) the chamber 24 may be closed (relatively moving the tools 30, 31 along direction of arrow A2). Then, a vacuum device 26 connected to the packaging chamber 24 and configured for removing gas from inside said packaging chamber may be operated; the vacuum device 26 may comprise at least one vacuum pump 26*a* active on at least one evacuation line 25 connecting the inside of said chamber 24 to the vacuum pump 26*a;* at least one valve 26*b* may also be provided (and for example be part of the vacuum device 26) for selectively opening and closing evacuation line 25; in one example a control unit 101 may be configured such that during the vacuum cycle the vacuum pump 26*a* is continuously operated, while the valve is opened or closed in order to extract or not gas from the vacuum or packaging chamber 24; alternatively the vacuum pump 26*a* is constantly switched on and operated, while the control unit only controls (during the vacuum cycle) the valve 26*b* to open or close to respectively withdraw or not gas from the vacuum or packaging chamber 24; the vacuum pump 26*a* and/or the valve 26*b* are controlled to withdraw gas from said packaging chamber 24 at least when the packaging assembly is in said second operating condition, i.e. with said packaging chamber hermetically closed. The support or tray 22 may include holes located in its side wall or base wall which facilitate gas withdrawal from a volume above the tray or support and under the film sheet. Should the tray or support include no holes then the film sheet 23*a* is kept separate from the tray or support while vacuum device 26 is active.

Once a desired state of vacuum is reached inside the chamber 24, and after the peripheral portion of the film sheet has been sealingly fixed to the support or to the tray rim, the holding means 38 release the film sheet(s) 23*a*. The vacuum present in chamber 24 causes the film sheet(s) 23*a* to drape down to the tray or support and to form a skin around the product also attaching to the tray or support surface not occupied by the product, thereby forming a skin packaged product which may be extracted from chamber 14.

Although FIGS. 2-4 show a possible vacuum skin packaging apparatus, it should be understood that the device and process of the invention may find application in other types of vacuum skin packaging apparatus. For example, the upper tool may be a single dome or a single plate without moving parts. Furthermore, it is not excluded that the film 23 be fed to the packaging assembly without being pre-cut into film sheets and rather remaining in the form of a continuous film. Moreover the trays 22 could take any shape (even that of a flat plate) and could either be pre-formed or formed in line by an appropriate thermoforming station. In a further option, the upper film may not be thermoformed on the product and is sealed to tray flange (but not on all the surface).

More in general, the device and method of the invention may find application in any packaging machine where there is a vacuum cycle. As an another example, the device and method of the invention may also be applied to the packaging apparatus 41 schematically shown in FIG. 5 comprising at least one support structure 42 supporting a thermoforming station 43 where a bottom film 47 coming from a feed roll 47*a* is thermoformed defining a continuous body or support 49 provided with a plurality of cavities 49*a* where products P may be positioned. A top film 50 supplied by a further feed roll 50*a* is sealed above the continuous body 49 to seal the plurality of cavities 49*a*. For example the top film 50 may be heat sealed to the continuous body 49 at a heat sealing station 51 positioned at a distance from the thermoforming station 43. The heat sealing station may comprise an upper and a lower tools 52, 53 similar to tools 30, 31 shown in FIGS. 3-5 a part from the fact that their internal geometry is adapted to receive the continuous body and the continuous top film. Before heat sealing the top film to the continuous body and once the upper and lower tools 52, 53 have been approached to each other to form a closed vacuum chamber 54, a vacuum device 56 connected to the vacuum chamber 54 and configured for removing gas from inside said vacuum chamber 54 may be operated; the vacuum device 56 may comprise at least one vacuum pump 58 active on at least one evacuation line 55 connecting the inside of said chamber 54 to the vacuum pump 58; at least one valve 59 may also be provided for selectively opening and closing evacuation line 55; the vacuum pump 58 and/or the valve 59 are controlled to withdraw gas from said vacuum chamber 54 at least when vacuum chamber is hermetically closed. Once a desired state of vacuum is reached inside the chamber 54, the top film 50 is sealingly fixed to the continuous body 48 and drapes down to continuous body 49 to form a skin around the product P also attaching to surface of the continuous body not occupied by the product, thereby forming a plurality of skin packaged products which may be extracted from chamber 54 and then separated the one from the other.

Also in this case, in one example, a control unit 101 may be configured such that during the vacuum cycle the vacuum pump 58 is continuously operated, while the valve 59 is opened or closed in order to extract or not gas from the vacuum or packaging chamber 54; alternatively the vacuum pump 58 may be constantly switched on and operated, while the control unit only controls (during the vacuum cycle) the valve 59 to open or close to respectively withdraw or not gas from the vacuum or packaging chamber 54.

According to one aspect, the above described vacuum skin packaging apparatuses of FIGS. 1-5 include the device 100 for setting vacuum time according to the invention which is described below.

According to a further aspect, the above described vacuum skin packaging apparatuses of FIGS. 1-5 implement a packaging process using the method of setting vacuum time according to the invention which is also described herein below.

The device 100 and the method of setting vacuum time are described only once for all above described apparatuses 1, 21, 51 and related packaging processes as the features of device 100 and of the method of setting vacuum time according to the invention are the same irrespective of the apparatus being apparatus 1 or apparatus 21 or apparatus 51. In other words each one of the apparatuses 1, 21 and 51 described above comprises a device 100 having the features described below and claimed; moreover each one of the apparatuses 1, 21, 51 implements a packaging process comprising a method of setting vacuum time as described below and claimed.

The device 100 is configured for implementing a method which properly sets vacuum time, i.e., the time interval during which vacuum device 6, 26 or 56 is operated and gas withdrawn from vacuum chamber 4, 24, or 54 of apparatus 1, 21 or 51, such that duration of the packaging cycle is optimized, yet without impairing on gas removal. The device 100 comprises a control unit 101 communicatively connectable (e.g. wired or wireless connectable) to the vacuum device 6, 26 or 56 of the apparatus 1, 21 or 51. Each one of the apparatus 1, 21, 51 comprises a pressure sensor 102 and/or to a humidity sensor 103 also communicatively connected with control unit 101: the pressure sensor is configured to detect pressure present in the vacuum chamber 4, 24, 54 or in a conduit connected to the vacuum chamber; for example, as shown in the attached figures the pressure sensor 102 may be located inside the vacuum chamber 4, 24, 54. The humidity sensor 103 is configured to detect a humidity parameter of gas present in the vacuum chamber or in a conduit connected to the vacuum chamber; for example, as shown in the attached figures the humidity sensor 103 may be located inside the vacuum chamber 4, 24, 54. It is not excluded that both a pressure sensor and a humidity sensor be used in each apparatus 1, 21, 51 and that therefore the control unit 101 be connected with both sensors 102 and 103. The control unit 101 of the device 100 may be a dedicated control unit or it may be part of the control unit of the apparatus 1, 21 or 51. In a possible embodiment a single control unit may be used controlling all operations of the packaging apparatus and thus configured for also implementing the control unit of device 100.

Figure 6:
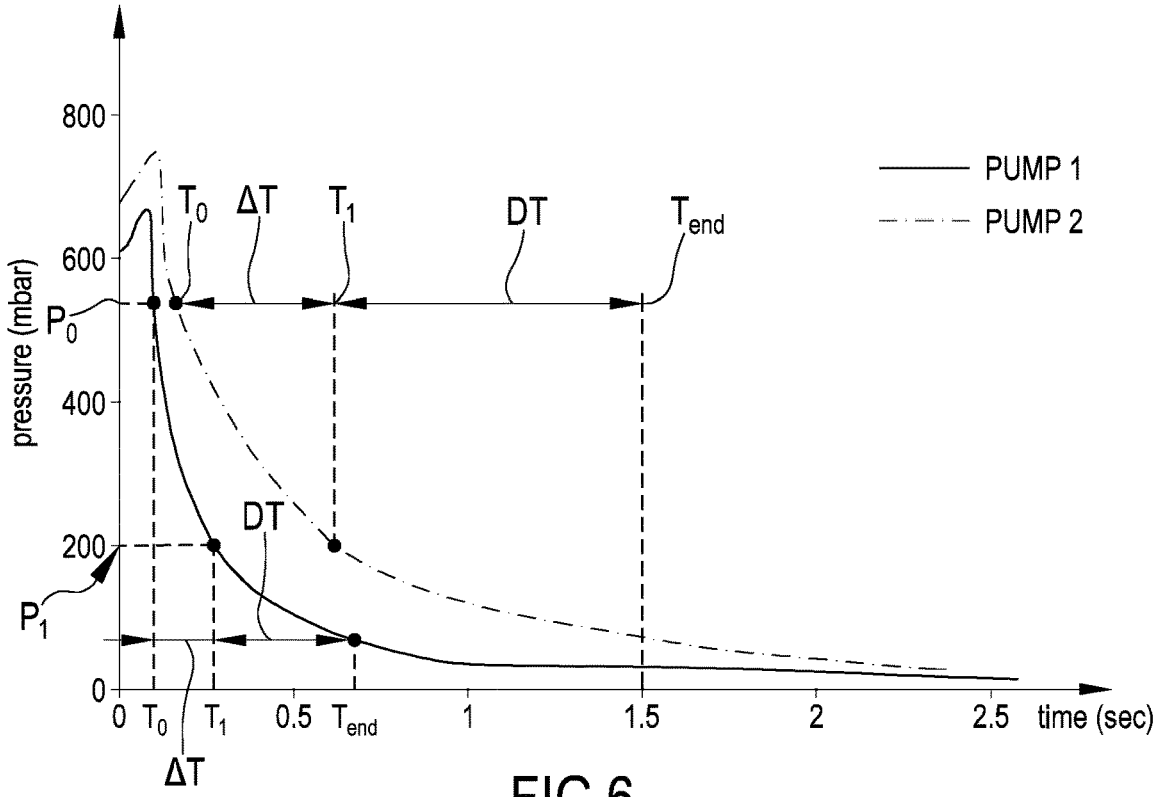
FIGS. 6 and 7 represent on a Cartesian system, where the abscissa is time (in seconds) and the ordinate is pressure (in mbar), two exemplifying curves of pressure over time during a vacuum cycle using an apparatus of the type shown in FIGS. 2-4 (note similar curves are obtainable with the other apparatuses herein described); a first curve (continuous line) is obtained withdrawing gas at given volumetric flow rate (PUMP1) from a vacuum chamber of a given volume, while the second curve (dashed line) is obtained withdrawing gas from the same vacuum chamber at about half the volumetric flow rate (PUMP 2 operates at 50% flow rate of PUMP1)
Figure 9:
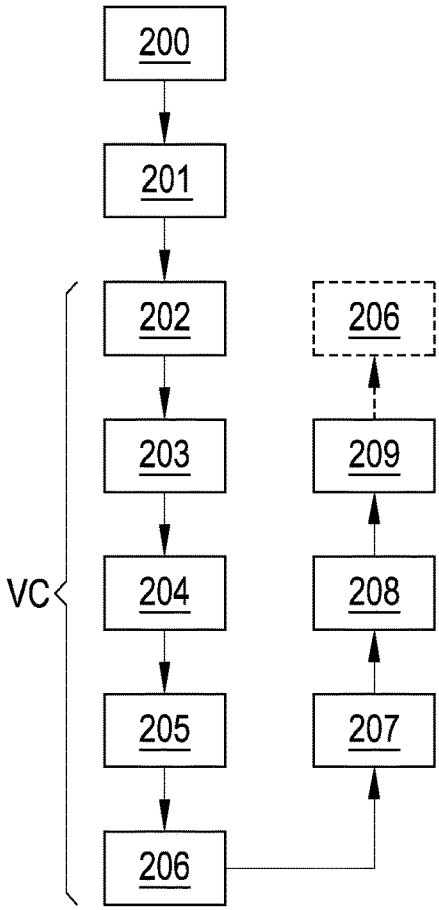
FIGS. 9 and 10 are flowcharts of exemplifying methods of setting vacuum time implemented according to aspects of the invention.

As described above, when the apparatus 1 is in the condition shown in FIG. 1 (i.e., with the terminal portion 9 and the open end 9*a* of semi-sealed package 8 positioned inside the vacuum chamber 14) or when the apparatus 21 is in the condition shown in FIG. 4 (i.e., with the support or tray 22 and the respective film sheet 23*a* inside the closed vacuum chamber 14) or when the apparatus 51 is in the condition shown in FIG. 6 (i.e., with a portion of the continuous body 49 and a portion of the top film 50 hosted inside the closed vacuum chamber 54), the control unit 101 is configured for executing a method of setting the vacuum time comprising the vacuum cycle described below and schematically represented in the flowchart of FIG. 9. The vacuum cycle of the method of the invention is aimed at removing gas from the vacuum chamber in an efficient manner and within a reasonable time.

Figure 7:
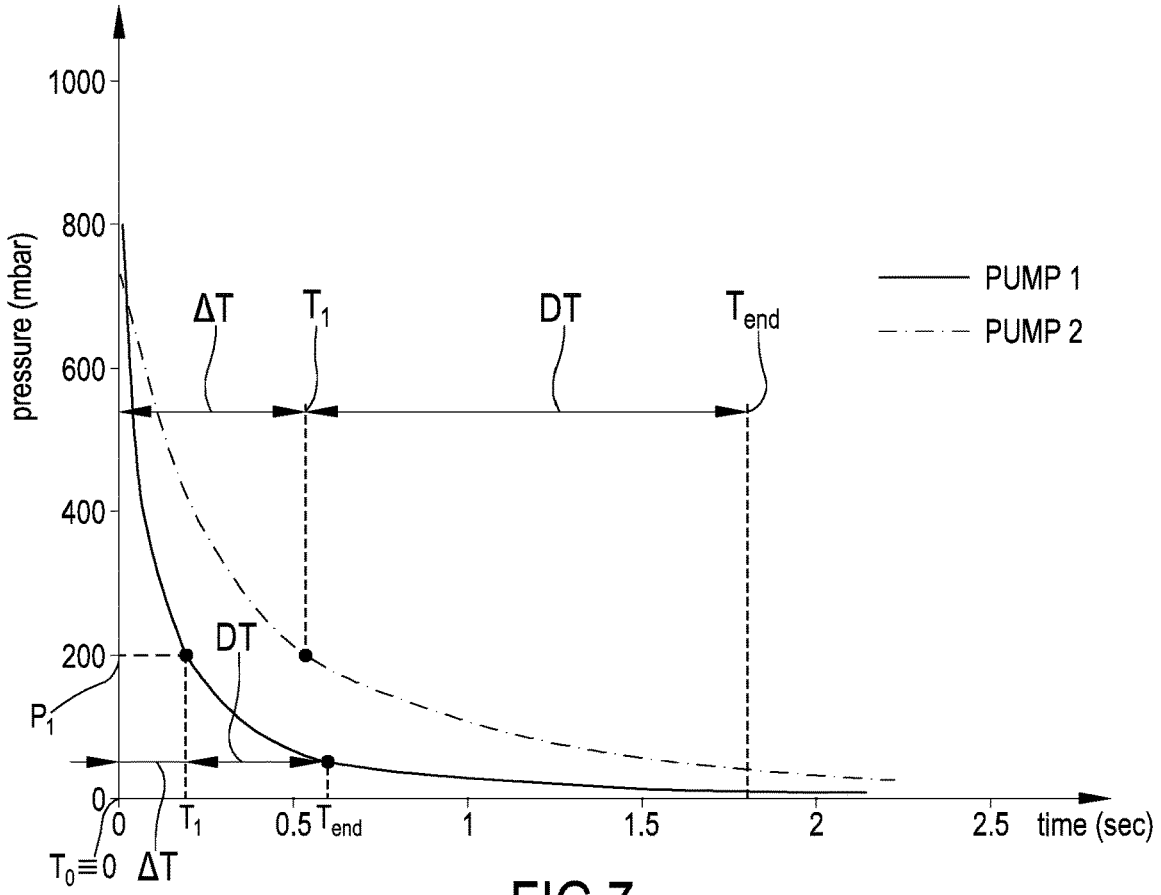
Figure 10:
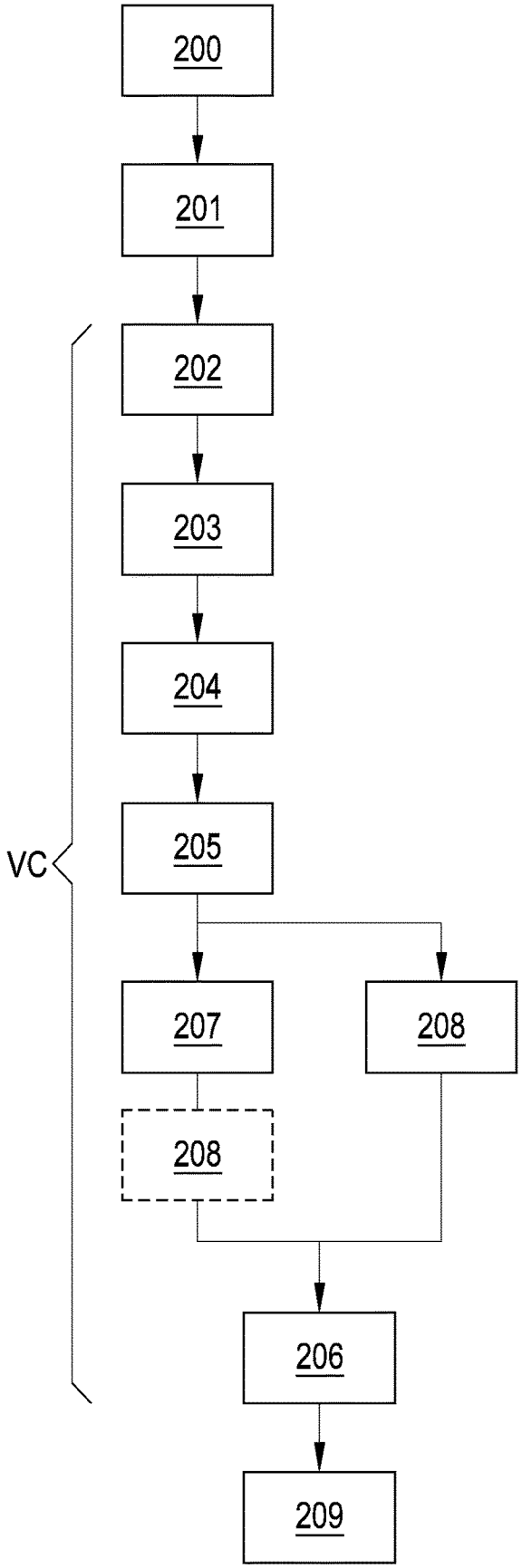

In detail, with reference to the flowchart of FIG. 9, which represents the main steps of a skin packaging process, the vacuum cycle may start after having properly positioned (step 200) the semi-sealed package or the terminal portion thereof or the support and film sheet or the continuous body and top film in the respective vacuum chamber and after having closed the vacuum chamber (step 201). The vacuum cycle VC then starts and comprises commanding the vacuum device 6, 26, or 56 to extract gas (step 202 in FIG. 9) from the vacuum chamber 4, 24, 54 and, while gas is being extracted via evacuation line 5, 25, or 55, receiving pressure signals from the pressure sensor and/or humidity signals from the humidity sensor (step 203). The pressure signals and the humidity signals are then used by the control unit 101 for determining at least one reference time instant $T_1$ in the vacuum cycle (step 204), which triggers the determination by the control unit of a delay time DT (step 205) at the expiration of which the control unit 101 commands the vacuum device to stop extracting gas from the vacuum chamber (step 206). Then the packaging process provides for defining one or more seals (e.g., heat sealing bands) to form a sealed package (step 207) and for re-venting the vacuum chamber (step 208) and opening the vacuum chamber (step 209) for allowing removal from the vacuum chamber of the sealed package so formed. Note that depending upon the type cycle, the step of re-venting 208 and the step of sealing 207 may be one after the other with the step of sealing taking place before or after re-venting. Alternatively, sealing may take place while re-venting is still ongoing. Furthermore, the step of stopping extraction of gas 206 may take place after re-venting 208: in FIG. 10 it is shown an alternative where step 206 of stopping gas extraction takes place after re-venting (step 208) and after sealing the package (step 207), with sealing the package which may take place during re-venting or after re-venting. In a further alternative, the step of stopping gas extraction may even last during the initial opening phase of the vacuum chamber, i.e., after initiation of step 209 (this possibility is represented in dashed lines in FIG. 9. FIGS. 6 and 7 represent in a Cartesian system, where the abscissa is time (in seconds) and the ordinate is pressure (in mbar), two exemplifying curves of pressure over time during the vacuum cycle, i.e., during gas withdrawal from the vacuum chamber 4, 24, 54. In the examples of FIGS. 6 and 7, the reference time instant $T_1$ is the instant when pressure detected by sensor 102 goes down to 200 mbar. As it is visible from FIGS. 6 and 7, at the reference time instant $T_1$ the control unit adds the delay time DT and calculates an end time $T_{end}$ at which one of the following takes place:

either the vacuum cycle stops and the control unit commands the vacuum device to stop extracting gas from the vacuum chamber or the vacuum cycle is about to stop and a prescribed further step (or steps) immediately preceding the end of the vacuum cycle (and the stop of gas extraction) take(s) place: for example as already mentioned re-venting air through apertures 48 and/or sealing of the package and/or start opening the vacuum chamber may take place while gas extraction is still operated; in a possible variant at $T_{end}$ the control unit 101 may command a step of re-venting (e.g., by controlling pump 38 to inject air or a valve placed on line 48*a* leading to apertures 48 to vent apertures 48 to the atmosphere), while the vacuum device 26 is operative to continue extract gas from the vacuum chamber; then, for example after a given time interval sufficient for the sealing of the film or film sheet 28*a* to the underlying tray to be completed, re-venting and gas extraction may be interrupted, and the vacuum chamber opened thereby actually ending the vacuum cycle.

In other words the control unit is configured to cause execution of at least one further step which brings to the actual end of the vacuum cycle: the at least one further step may be immediate stop of gas extraction or execution of an auxiliary event (re-venting air through apertures 48 and/or sealing of the package and/or start opening the vacuum chamber) before commanding stop of gas extraction from the vacuum chamber. The delay time interval DT is not a constant value but its duration depends upon when the reference time instant $T_1$ takes place. In other words, first the reference time instant is determined according to one of the criteria explained below and then a delay time interval DT added: as already explained, the duration of delay time DT is not a constant pre-set value, but calculated preferably at each cycle the reference time instant may not happen always at the same moment after start of the vacuum cycle (and thus DT varies) due to many factors such as by way of non-limiting example type of vacuum pump used, setting of the vacuum pump (this is shown in FIGS. 6 and 7, which represent the curve followed when using to substantially different gas extraction pump settings), temperature conditions, size of the product/package treated during the cycle, volume of the vacuum chamber). As shown in FIGS. 6 and 7, the entity or duration of the delay time interval DT and thus the moment when the end time takes place are calculated based on when, in the vacuum cycle, the reference time instant $T_1$ takes place: in one example, the later the reference time instant takes place in the vacuum cycle, the longer is the time interval DT duration.

Going back to the determination of the reference time instant $T_1$, it should be noted that according to one aspect the control unit 101 may be configured for determining the reference time instant $T_1$, using the pressure signals coming from pressure sensor 102, as the instant when pressure reaches or goes below a threshold defined by a set pressure value $P_1$, which is significantly lower than atmospheric pressure.

In a second alternative, the control unit 101 may be configured for determining the reference time instant $T_1$ from the pressure signals coming from pressure sensor 102 as the instant when a pressure variation parameter, which is related to pressure variation over time, drops below a respective set value. In accordance with a further aspect of this second alternative, the pressure variation parameter is, or is function of, pressure derivative over time dP/dt. For example, the control 101 may be configured for determining the reference time instant $T_1$ from the pressure signals coming from pressure sensor 102 as the instant when an absolute value of pressure derivative over time dP/dt drops below a set pressure derivative value ($(dP/dt)_1$) or when the absolute value of derivative of pressure over time divided by the pressure ((dP/dt)/P) drops below a respective set value ($((dP/dt)/P)_1$. In particular, the control unit 101 may be configured for determining the reference time instant $T_1$ as the instant when an absolute value of pressure derivative over time is below a given threshold which is a set value (e.g. a set pressure derivative value ($(dP/dt)_1$ or a set % of an initial pressure derivative value) or when the absolute value of derivative of pressure over time divided by the pressure (dP/dt)/P drops below a given threshold (e.g. a set value ($((dP/dt)/P)_1$ or a set % of an initial value of (dP/dt)/P). For example, referring to the exemplifying curves reported in the drawings of FIGS. 6 and 7, the reference time instant may be identified as instant when the tangent to the pressure vs. time curve represented in FIGS. 6 and 7 takes a defined inclination (for example an inclination sufficiently close to the horizontal) or as instant when the inclination of the tangent to the pressure vs. time curve represented in FIGS. 6 and 7 changes more than a given set value or percentage value compared to a reference or starting inclination value.

In a third alternative, the control unit 101 may be configured for determining the reference time instant $T_1$ from the humidity signals coming from humidity sensor 103 as the instant when the humidity parameter, for example relative humidity, reaches a given threshold which in this case is a set humidity parameter value ($H_1$). The selection of which of the above alternatives adopting and the selection for each alternative of the appropriate threshold may be made depending upon whether the product to be packaged contains or not water, as it will be further explained here below.

Once the reference time instant $T_1$ is determined using one of the above methodologies, the delay time interval DT can be calculated and the end time $T_{end}$ determined ($T_{end}$=DT+$T_1$) at which either gas extraction from the vacuum chamber is interrupted and the vacuum cycle is interrupted (step 206 in FIG. 9) or a further step or action immediately antecedent to interruption of gas extraction is commanded such as re-venting of gas through apertures 48 in the example of FIGS. 2-4 and/or start opening of the vacuum chamber as explained above (steps 207, 208 in FIG. 10).

In accordance with a further aspect, the duration of delay time interval DT may be calculated (step 205 in FIGS. 9 and 10) as a function of a duration of a start time interval ΔT lasting from a start time instant $T_0$, which is on its turn determined as explained below, until the reference time instant $T_1$.

In accordance with a first alternative, the start time instant To is the instant when the control unit commands extraction of gas from the vacuum chamber to begin; thus, the start time instant follows closure of the vacuum chamber 4, 24, 54 with controlled extraction of gas taking place only via evacuation line or lines 5, 25, 55 and is represented in FIG. 7 as $T_0$=0 because it corresponds with actual start of gas evacuation.

Figure 8:
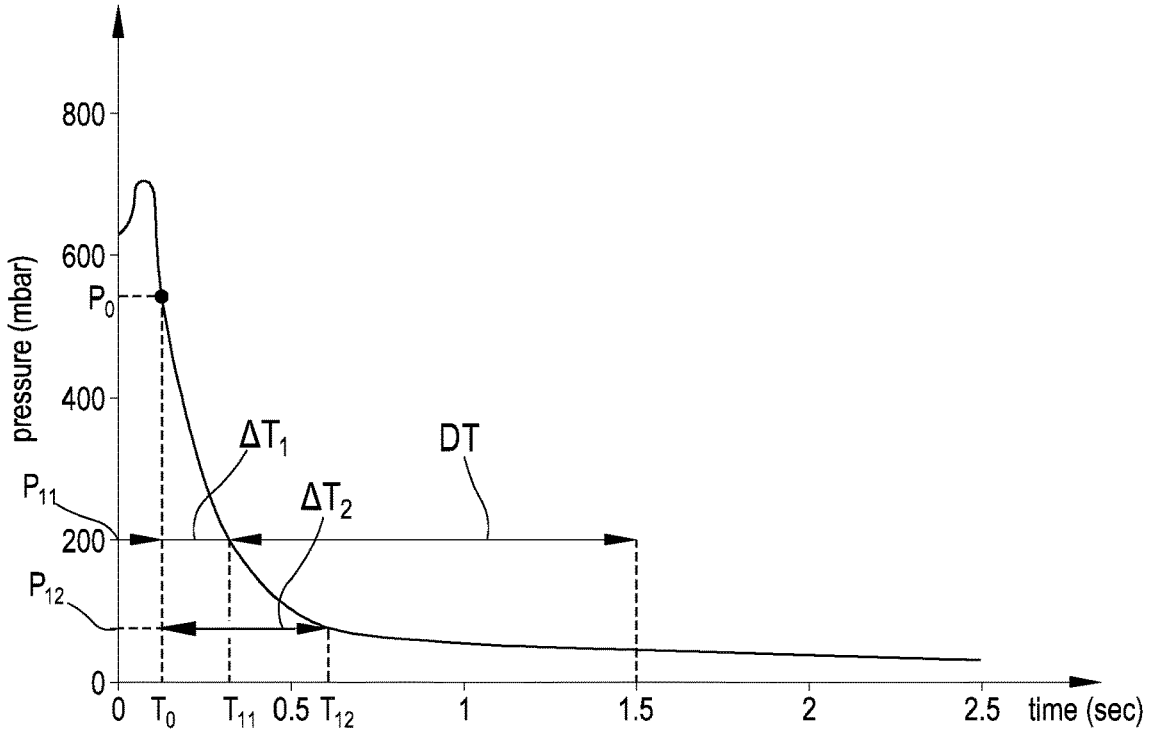
FIG. 8 represents on a Cartesian system, where the abscissa is time (in seconds) and the ordinate is pressure (in mbar), an exemplifying curve of pressure over time during a vacuum cycle using an apparatus of the type shown in FIGS. 2-4 (note similar curves are obtainable with the other apparatuses herein described); the curve is obtained withdrawing gas at given volumetric flow rate from a vacuum chamber of a given volume.

In accordance with a second alternative, the start time instant $T_0$ is an instant delayed from the instant when the control unit commands extraction of gas from the vacuum chamber to begin (see FIGS. 6 and 8). This second methodology may account for leakages which may take place during an initial phase of the vacuum cycle and thus slightly delays compared to the first alternative the instant which the start time instant $T_0$ is considered to take place compared to actual start of gas extraction. In accordance with this second alternative, the start time instant $T_0$ is either set at a predefined delay from start of the gas evacuation or it is determined from the pressure signals coming from pressure sensor 102 as instant when pressure reaches a reference pressure value $P_0$ which is below the value of atmospheric pressure present outside the vacuum chamber and above said set pressure value $P_1$. The reference pressure value $P_0$ is sensibly greater than (for example at least twice) the set pressure value $P_1$; in a particular currently preferred embodiment, the reference pressure value $P_0$ is comprised between 500 and 800 mbar, while the set pressure value $P_1$ is comprised between 30 and 300 mbar.

Once the start time instant $T_0$ is determined according to one of the above two alternative procedures, and thus once the start time interval ΔT is determined ($\Delta T=T_1-T_0$), the duration of the delay time interval DT is calculated as the product of the duration of the start time interval ΔT times a given factor K. K may be a constant given factor, which is pre-fixed for each type of apparatus or K may be set by the operator depending on the level of vacuum he wants to get: in this last case the control unit 101 is programmed to receive the value of K set by the operator (for example the control unit may be operatively connected to a user interface operable by a user for the input of the K value. Once DT has been determined as above described, the control unit commands the vacuum device to continuously maintain gas extraction from said vacuum chamber for a cycle evacuation time CET beginning at the moment gas evacuation is started and lasting at least until expiration of said delay time interval DT, i.e., until $T_{end}$ shown in FIGS. 7 and 8. As we said evacuation of gas may be terminated exactly at expiry of DT or it may be procrastinated for a further given delay time δt or until completion of certain prescribed events (such as one or more of re-venting of the vacuum chamber, start opening of the vacuum chamber, sealing of the package, as explained above). The duration of the cycle evacuation time CET is thus:

the sum of the duration of the start time interval ΔT plus the duration of the delay time interval DT (FIG. 7), or the sum of the time interval from start of gas evacuation until time $T_0$ plus the duration of the start time interval ΔT plus the duration of the delay time interval DT (FIG. 6 or 8), or the sum of the duration of the start time interval ΔT plus the duration of the delay time interval DT, plus the duration of further given delay time δt (which may be either a constant or linked to completion of certain events as above described), or the sum of the time interval from start of gas evacuation until time To plus the duration of the start time interval ΔT plus the duration of the delay time interval DT, plus the duration of further given delay time δt (which may be either a constant or linked to completion of certain events as above described).

For example, if the product to be packaged is a dry product such as a non-biological or a food article with low content of water (i.e. a content of water below 25% by weight, for example sugar, peanuts, almonds, dried food) a single reference time instant $T_1$ may be determined from the pressure signals as the instant when pressure reaches a set pressure value $P_1$ comprised between 30 and 300 mbar, and then the duration of the delay time interval DT may be made calculating the product of the duration of the start time interval ΔT times given factor K, which is a constant greater than zero according to the formula:

$$DT=K\cdot(\Delta T) \quad (1)$$

where $0\leq K\leq 10$, for example K=0.1 or 0.5 or 1 or 1.5 or 2 or 2.5 or 3 or 3.5 or 4 or 5 or 6 or 7 or 8 or 9 or 10.

In FIGS. 6 and 7 two pressure curves are represented in each figure, one (the continuous line) obtained using a vacuum device with a vacuum pump (pump 1 curve in figures and 7) operating at a given flow rate and the other (dashed line) obtained using a vacuum pump (pump 2 curve in FIGS. 6 and 7) operating at half the flow rate of pump 1: as it can be seen in each case DT is K times (in the cases shown 2 times) ΔT irrespective of the curve; thus irrespective of the vacuum pump used or of the vacuum pump setting imposed to the pump, when DT expires (namely at $T_{end}$) the same level of vacuum is reached. The same happens even if the size of the product or the size of the vacuum chamber change, thus making the setting of the vacuum time according to the invention independent from these factors and yet leading to a constant vacuumization of the package.

Alternatively, if the product to be packaged is a wet product or a food product with relatively high content of water (for example higher than 50% by weight as in fruits, vegetables, most meats, soups) the single reference time instant $T_1$ may be determined as the time when water starts to evaporate using one of the following three variants:

$T_1$ is determined from the pressure signals as the instant when pressure reaches a set pressure value $P_1$ comprised between 5 and 40 mbar: in fact depending upon the temperature conditions at this range of pressure starts to evaporate and quickly turn into vapor facilitating gas extraction and thus affecting evacuation time for a same quality of vacuum; note $P_1$ may be pre-set or set by the user via a user interface connected to the control unit 101: in practice once the user knowns the product temperature he may set the appropriate value of $P_1$; alternatively the control unit 101 may receive from the user or from a temperature sensor an information related to the temperature of the product or of the atmosphere surrounding the product, and calculate the set pressure value $P_1$ as a function of the temperature of the product or of the atmosphere surrounding the product.

$T_1$ is determined from the pressure signals as the instant when a pressure variation parameter, which is related to pressure variation over time, drops below a respective set value. The pressure variation parameter is, or is function of, pressure derivative over time dP/dt. For example, the control 101 may be configured for determining the reference time instant $T_1$ from the pressure signals coming from pressure sensor 102 as the instant when an absolute value of pressure derivative over time dP/dt drops below a set pressure derivative value ($(dP/dt)_1$) or when the absolute value of derivative of pressure over time divided by the pressure ((dP/dt)/P) drops below a respective set value $((dP/dt)/P)_1$. In particular, the control unit 101 may be configured for determining the reference time instant $T_1$ as the instant when an absolute value of pressure derivative over time is below a given threshold which is a set value (e.g. a set pressure derivative value ($(dP/dt)_1$ or a set % of an initial pressure derivative value) or when the absolute value of derivative of pressure over time divided by the pressure (dP/dt)/P drops below a given threshold (e.g. a set value $((dP/dt)/P)_1$ or a set % of an initial value of (dP/dt)/P);

$T_1$ is determined from the humidity signals coming from sensor 103: the reference time instant $T_1$ is in this case the instant when the humidity parameter reaches a set humidity parameter value $H_1$: for example the humidity parameter may be relative humidity and the set humidity parameter value $H_1$ may comprised between 70 and 100% of relative humidity; in fact, in case of high content of water in the product, determining when the above humidity parameter becomes sufficiently high corresponds at determining the condition when water starts to evaporate and quickly turn into vapor facilitating gas extraction and thus affecting evacuation time for a same quality of vacuum.

In each of these three variants (particularly suitable for packaging products with high content of water), the duration of the delay time interval DT may be made calculating the product of the duration of the start time interval ΔT times the factor K, which is a constant greater than zero according to the formula (1) reported above. Although not represented in the figures, also in this case when DT expires (namely at $T_{end}$) substantially the same level of vacuum is reached irrespective of the vacuum pump used or of the vacuum pump setting imposed to the pump, or of the size of the product/size of the chamber.

In accordance with a further alternative (see FIG. 8), which basically combines the procedures just described, the control unit may be configured for determining, in the vacuum cycle, a first reference time instant $T_{11}$ and a second reference time instant $T_{12}$ as follows. The first reference time instant $T_{11}$ is determined from the pressure signals as the instant when pressure reaches a first set pressure value $P_{11}$ comprised between 100 and 300 mbar. On the other hand, the second reference time instant $T_{12}$ is determined either:

from the pressure signals, the second reference time instant $T_{12}$ being the instant when pressure reaches a second set pressure value $P_{12}$ comprised between 5 and 40 mbar; or from the pressure signals, the second reference time instant $T_{12}$ being the instant when the absolute value of pressure derivative over time is below a set pressure derivative value $((dP/dt)_1)$; or from the pressure signals, the second reference time instant $T_{12}$ being the instant when the absolute value of derivative of pressure over time divided by the pressure ((dP/dt)/P) drops below a respective set value $((dP/dt)/P)_1$;

from the humidity signals, the second reference time instant $T_{12}$ being the instant when the humidity parameter reaches a set humidity parameter value ($H_1$).

The control unit is then configured for calculating a first duration of the start time interval $\Delta T_1$ extending from the start time instant $T_0$ until the first reference time instant $T_{11}$, and for calculating a second duration of the start time interval $\Delta T_2$ extending from the start time instant $T_0$ until the second reference time instant $T_{12}$ (again see FIG. 8 where the two durations of the start time interval are shown).

Then the control unit calculates the duration of the delay time interval DT as a function of the first duration of the start time interval $\Delta T_1$ and of the second duration of the start time interval $\Delta T_2$. In particular, the control unit may be configured to make a linear combination by making the sum of the product of the first duration of the start time interval $\Delta T_1$ times a first given factor $K_1$ plus the second duration of the start time interval $\Delta T_2$ times a second given factor $K_2$, according to the formula:

$$DT=K_1\cdot(\Delta T_1)+K_2\cdot(\Delta T_2) \quad (2)$$

where $0 \le K_1 \le 5$, and $0 \le K_2 \le 5$,

For example $K_1$=0.5 or 1 or 1.5 or 2 or 2.5 or 3 or 3.5 or 4 or 4.5 or 5, and $K_2$=0.5 or 1 or 1.5 or 2 or 2.5 or 3 or 3.5 or 4 or 4.5 or 5.

Although in FIG. 8 $\Delta T_2$ starts from $T_0$, formula (2) may be used also if $\Delta T_2$ is calculated as starting from $T_{11}$. Both if $\Delta T_2$ measured starting from $T_0$ or from $T_{11}$, above formula (2) for DT applies, as it is just a matter of different values of K1 and K2 being used. For example, if $\Delta T_2$ starts at $T_0$ we may have certain values for $K1(T_0)$ and $K2(T_0)$. If it starts from $T_{11}$ we may have values $K2(T_{11})=K2(T_0)$ and $K1(T_{11})= K1(T_0)+K2(T_{11})$ Also in the alternative using formula (2), once DT has been determined as above described the control unit commands the vacuum device to continuously maintain gas extraction from said vacuum chamber for a cycle evacuation time CET beginning at the moment gas evacuation is started and lasting at least until expiration of said delay time interval DT. Evacuation of gas may be terminated exactly at expiry of DT or it may be procrastinated for a further given delay time δt or until completion of certain prescribed events (such as one or more of re-venting of the vacuum chamber, start opening of the vacuum chamber, sealing of the package, as explained above). The duration of the cycle evacuation time CET may be:

the sum of the duration of the start time interval $\Delta T_1$ (for products with content of water below 25% by weight) or $\Delta T_2$ (for products with content of water grater or equal than 25% by weight) plus the duration of the delay time interval DT, or the sum of the time interval from start of gas evacuation until time $T_0$ plus the duration of the start time interval $\Delta T_1$ (for products with content of water below 25% by weight) or $\Delta T_2$ (for products with content of water grater or equal than 25% by weight) plus the duration of the delay time interval DT (FIG. 9), or the sum of the duration of the start time interval $\Delta T_1$ (for products with content of water below 25% by weight) or $\Delta T_2$ (for products with content of water grater or equal than 25% by weight) plus the duration of the delay time interval DT, plus the duration of further given delay time δt (which may be either a constant or linked to completion of certain events as above described), or the sum of the time interval from start of gas evacuation until time $T_0$ plus the duration of the start time interval $\Delta T_1$ (for products with content of water below 25% by weight) or $\Delta T_2$ (for products with content of water grater or equal than 25% by weight) plus the duration of the delay time interval DT, plus the duration of further given delay time δt (which may be either a constant or linked to completion of certain events as above described).

Control Unit of Apparatus 1

The device 100 according to the invention has at least one control unit indicated as 101. The control unit 101 may be a distinct unit or it may be part of the control unit of the packaging apparatus 1, 21, 51.

The control unit 101 may comprise a digital processor (CPU) with memory (or memories), an analogical type circuit, or a combination of one or more digital processing units with one or more analogical processing circuits. In the present description and in the claims it is indicated that the control unit 101 is "configured" or "programmed" to execute certain steps: this may be achieved in practice by any means which allow configuring or programming the control unit. For instance, in case of a control unit 101 comprising one or more CPUs, one or more programs are stored in an appropriate memory: the program or programs containing instructions which, when executed by the control unit, cause the control unit 101 to execute the steps described and/or claimed in connection with the control unit. Alternatively, if the control unit 101 is of an analogical type, then the circuitry of the control unit is designed to include circuitry configured, in use, to process electric signals such as to execute the control unit steps herein disclosed.

The control unit 101 may be configured to execute any one of the steps described above or any one of the steps claimed in the appended claims.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A device for setting vacuum time in a packaging apparatus, the packaging apparatus comprising:

a vacuum chamber;

a vacuum device configured to extract gas from the vacuum chamber; and a sensor, wherein the sensor includes at least one of:

a pressure sensor configured to detect a pressure present in the vacuum chamber or in a conduit connected to the vacuum chamber, or a humidity sensor configured to detect a humidity parameter of gas present in the vacuum chamber or in a conduit connected to the vacuum chamber; and a control unit communicatively coupled to the vacuum device and to the sensor;

wherein the control unit is configured to:

cause the vacuum device to extract gas from the vacuum chamber;

receive a sensor signal, wherein the sensor signal is at least one of a pressure signal from the pressure sensor or a humidity signal from the humidity sensor;

determine a reference time instant in the vacuum cycle, wherein determining the reference time instant comprises at least one of:

determining, from the pressure signal, the reference time instant based on an instant when the pressure drops below a set pressure value, determining, from the pressure signal, the reference time instant based on an instant when a pressure variation parameter drops below a respective set value, determining, from the humidity signal, the reference time instant based on an instant when the humidity parameter reaches a set humidity parameter value;

calculate a duration of a delay time at least based on when, in the vacuum cycle, the reference time instant takes place; and control the vacuum device to maintain gas extraction from the vacuum chamber at least for the delay time interval following the reference time instant;

wherein the duration of the delay time interval is calculated as a function of a duration of a start time interval lasting from a start time instant until the reference time instant; and wherein the start time instant is defined according to either:

the start time instant is the instant when the control unit commands extraction of gas from the vacuum chamber to begin, or the start time instant is delayed from the instant when the control unit commands extraction of gas from the vacuum chamber to begin, the start time instant being determined from the pressure signal as an instant when pressure reaches a reference pressure value which is below a value of atmospheric pressure present outside the vacuum chamber and above the set pressure value.

2. The device of claim 1, wherein:

the duration of the delay time interval is not a constant pre-set value and the control unit is configured to calculate, during each vacuum cycle, the duration of the delay time;

the duration of the delay time is calculated based on when, in the vacuum cycle, the reference time instant takes place; and the control unit is configured to cause, at an expiration of the calculated delay time interval following the reference time instant, execution of at least one further step which brings to end of the vacuum cycle;

the at least one further step includes at least one step from the group consisting of:

immediately commanding the vacuum device to stop gas extraction from the vacuum chamber and commanding execution of at least one prescribed event before commanding stop of gas extraction from the vacuum chamber.

3. The device of claim 1, wherein a duration of the delay time interval comprises calculating the product of the duration of the start time interval times a given factor.

4. The device of claim 1, wherein:

determining the reference time instant in the vacuum cycle comprises determining a single reference time instant;

the determining of the single reference time instant includes at least one selected from the group consisting of:

determining the reference time instant from the pressure signal, the reference time instant being an instant when the pressure drops below a set pressure value between 30 and 300 mbar, determining the reference time instant from the pressure signal, the reference time instant being an instant when pressure drops below a set pressure value between 5 and 40 mbar, determining the reference time instant from the pressure signal, the reference time instant being an instant when a pressure derivative over time, in absolute value, drops below a set pressure derivative value or changes by more than a given percentage relative to an initial value, determining the reference time instant from the pressure signal, the reference time instant being an instant when a pressure derivative over time divided by pressure, in absolute value, drops below a respective set pressure value or changes by more than a given percentage relative to an initial value, and determining the reference time instant from the humidity signal, the reference time instant being an instant when the humidity parameter reaches a set humidity parameter value, where the humidity parameter is relative humidity and the set humidity parameter value is between 70 and 100% of relative humidity; and the duration of the delay time interval is calculated as a product of the duration of the start time interval and a given factor, according to the formula:

$$DT=K\cdot(\Delta T) \quad (1)$$

where DT is the delay time interval, K is the given factor, and AT is the duration of the start time interval.

5. The device of claim 1, wherein:

determining the reference time instant in the vacuum cycle comprises determining a first reference time instant and a second reference time instant as follows:

determining the first reference time instant from the pressure signal, where the first reference time instant is an instant when the pressure drops below a first set pressure value that is between 30 and 300 mbar, determining the second reference time instant by at least one of the group consisting of:

determining, from the pressure signal, the second reference time instant as an instant when the pressure drops below a second set pressure value that is between 5 and 40 mbar, determining, from the pressure signal, the second reference time instant as an instant when the absolute value of a pressure derivative over time drops below a set pressure derivative value or changes by more than a given percentage relative to an initial value, determining, from the pressure signal, the second reference time instant as an instant when a pressure derivative over time divided by pressure, in absolute value, drops below a respective set pressure value or changes by more than a given percentage relative to an initial value, and determining, from the humidity signal, the second reference time instant as an instant when the humidity parameter reaches a set humidity parameter value; and the cycle comprises at least one of:

calculating a first duration of the start time interval extending from the start time instant until the first reference time instant, and calculating a second duration of the start time interval extending from the start time instant until the second reference time instant, or calculating a first duration of the start time interval extending from the start time instant until the first reference time instant, and calculating a second duration of the start time interval extending from the first reference time instant until the second reference time instant; and the cycle further comprises:

calculating a duration of the delay time interval as a function of the first duration of the start time interval and the second duration of the start time interval.

6. The device of claim 5, wherein:

calculating the duration of the delay time interval as a function of the first duration of the start time interval and of the second duration of the start time interval comprises making the sum of the product of the first duration of the start time interval times a first given factor plus the second duration of the start time interval times a second given factor, according to the formula:

$$DT=K1\cdot(\Delta T1)+K2\cdot(\Delta T2) \quad (2)$$

where DT is the duration of the delay time interval, K1 is the first given factor, ΔT1 is the first duration of the start time interval, K2 is the second given factor, and ΔT2 is the second duration of the start time interval.

7. The device of claim 1, wherein the control unit is configured to command the vacuum device to continuously maintain gas extraction from the vacuum chamber for a cycle evacuation time lasting until expiration of the delay time interval, wherein a duration of the cycle evacuation time is one of:

a sum of the duration of the start time interval plus the duration of the delay time interval;

a sum of a time interval from a start of gas evacuation until the start time instant plus the duration of the start time interval plus the duration of the delay time interval;

a sum of the duration of the start time interval plus the duration of the delay time interval, plus a duration of a further delay time, or a sum of the time interval from a start of gas evacuation until the start time instant plus the duration of the start time interval plus the duration of the delay time interval, plus a duration of a further delay time.

8. A method of setting vacuum time in a packaging apparatus, wherein:

the packaging apparatus comprises:

at least one vacuum chamber configured to receive one of:

a semi-sealed package to be vacuumized, the semi-sealed package containing a respective product, a support having a superior surface supporting or containing a product and a closure film above the support, or a continuous body having cavities for a product and a top film;

a vacuum device configured to extract gas from the vacuum chamber; and a sensor comprising at least one of:

a pressure sensor configured to detect pressure present in the vacuum chamber or in a conduit connected to the vacuum chamber, or a humidity sensor configured to detect a humidity parameter of gas present in the vacuum chamber or in a conduit connected to the vacuum chamber; and the method comprises execution of a vacuum cycle, wherein the vacuum cycle comprises:

commanding the vacuum device to extract gas from the vacuum chamber, receiving a sensor signal, the sensor signal comprising at least one of a pressure signal from the pressure sensor, or a humidity signal from the humidity sensor, performing at least one of the following steps for determining a reference time instant in the vacuum cycle:

determining, from the pressure signal, the reference time instant as an instant when the pressure drops below a set pressure value, determining, from the pressure signal, the reference time instant as an instant when a pressure variation parameter drops below a respective set value, determining, from the humidity signal, the reference time instant as an instant when the humidity parameter reaches a set humidity parameter value;

calculating a duration of a delay time at least based on when, in the vacuum cycle, the reference time instant takes place; and controlling the vacuum device to maintain gas extraction from the vacuum chamber at least for the duration of the delay time following the reference time instant;

wherein the duration of the delay time interval is calculated as a function of a duration of a start time interval lasting from a start time instant until the reference time instant; and wherein the start time instant is selected from the group consisting of:

an instant when the control unit commands extraction of gas from the vacuum chamber to begin, or a delay from an instant when the control unit commands extraction of gas from the vacuum chamber to begin.

9. The method of claim 8, wherein:

the duration of the delay time interval is not a constant pre-set value;

the duration of the delay time is calculated based on when, in the vacuum cycle, the reference time instant takes place; and at expiration of the delay time interval following the reference time instant, execution of at least one further step which brings to end of the vacuum cycle takes place, the at least one further step comprising at least one of:

immediately commanding the vacuum device to stop gas extraction from the vacuum chamber, or commanding execution of at least one prescribed event before commanding stop of gas extraction from the vacuum chamber.

10. The method of claim 8, wherein the delay time interval is calculated as a product of the duration of the start time interval times a given factor.

11. The method of claim 8, wherein:

determining the reference time instant in the vacuum cycle comprises determining a single reference time instant;

the determining of the single reference time instant includes at least one selected from the group consisting of:

determining the reference time instant from the pressure signal, the reference time instant being an instant when the pressure drops below a set pressure value between 30 and 300 mbar, determining the reference time instant from the pressure signal, the reference time instant being an instant when pressure drops below a set pressure value between 5 and 40 mbar, determining the reference time instant from the pressure signal, the reference time instant being an instant when a pressure derivative over time, in absolute value, drops below a set pressure derivative value or changes by more than a given percentage relative to an initial value, determining the reference time instant from the pressure signal, the reference time instant being an instant when a pressure derivative over time divided by pressure, in absolute value, drops below a respective set pressure value or changes by more than a given percentage relative to an initial value, and determining the reference time instant from the humidity signal, the reference time instant being an instant when the humidity parameter reaches a set humidity parameter value, where the humidity parameter is relative humidity and the set humidity parameter value is between 70 and 100% of relative humidity; and the duration of the delay time interval is calculated as a product of the duration of the start time interval and a given factor, according to the formula:

$$DT=K\cdot(\Delta T) \quad (1)$$

where DT is the delay time interval, K is the given factor, and ΔT is the duration of the start time interval.

12. The method of claim 8, wherein:

determining the reference time instant in the vacuum cycle comprises determining a first reference time instant and a second reference time instant as follows:

determining the first reference time instant from the pressure signal, the first reference time instant is an instant when the pressure drops below a first set pressure value that is between 30 and 300 mbar, determining the second reference time instant by at least one of the group consisting of:

determining, from the pressure signal, the second reference time instant as an instant when the pressure drops below a second set pressure value that is between 5 and 40 mbar, determining, from the pressure signal, the second reference time instant as an instant when the absolute value of a pressure derivative over time drops below a set pressure derivative value or changes by more than a given percentage relative to an initial value, determining, from the pressure signal, the second reference time instant as an instant when a pressure derivative over time divided by pressure, in absolute value, drops below a respective set pressure value or changes by more than a given percentage relative to an initial value, and determining, from the humidity signal, the second reference time instant as an instant when the humidity parameter reaches a set humidity parameter value; and the cycle comprises at least one of:

calculating a first duration of the start time interval extending from the start time instant until the first reference time instant, and calculating a second duration of the start time interval extending from the start time instant until the second reference time instant, or calculating a first duration of the start time interval extending from the start time instant until the first reference time instant, and calculating a second duration of the start time interval extending from the first reference time instant until the second reference time instant; and the cycle further comprises:

calculating a duration of the delay time interval as a function of the first duration of the start time interval and the second duration of the start time interval.

13. The method of claim 12, wherein:

calculating the duration of the delay time interval as a function of the first duration of the start time interval and of the second duration of the start time interval comprises making the sum of the product of the first duration of the start time interval times a first given factor plus the second duration of the start time interval times a second given factor, according to the formula:

$$DT=K1\cdot(\Delta T1)+K2\cdot(\Delta T2) \quad (2)$$

where DT is the duration of the delay time interval, K1 is the first given factor, ΔT1 is the first duration of the start time interval, K2 is the second given factor, and AT2 is the second duration of the start time interval.

14. The method of claim 8, wherein the vacuum cycle comprises commanding the vacuum device to continuously maintain gas extraction from the vacuum chamber for a cycle evacuation time lasting until expiration of the delay time interval, the duration of the cycle evacuation time being one of:

a sum of the duration of the start time interval plus the duration of the delay time interval;

a sum of a time interval from a start of gas evacuation until the start time instant plus the duration of the start time interval plus the duration of the delay time interval;

a sum of the duration of the start time interval plus the duration of the delay time interval, plus a duration of a further delay time, or a sum of the time interval from a start of gas evacuation until the start time instant plus the duration of the start time interval plus the duration of the delay time interval, plus a duration of a further delay time.

* * * * *